US006540155B1

(12) United States Patent
Yahav

(10) Patent No.: US 6,540,155 B1
(45) Date of Patent: Apr. 1, 2003

(54) AUTOMATIC SPRAY DISPENSER

(75) Inventor: Shimon Yahav, Rehovot (IL)

(73) Assignee: Gotit Ltd., Rehovot (IL)

( * ) Notice: Subject to any disclaimer, the term of this patent is extended or adjusted under 35 U.S.C. 154(b) by 0 days.

(21) Appl. No.: 09/582,295

(22) PCT Filed: Dec. 18, 1998

(86) PCT No.: PCT/IL98/00618

§ 371 (c)(1),
(2), (4) Date: Oct. 10, 2000

(87) PCT Pub. No.: WO99/34266

PCT Pub. Date: Jul. 8, 1999

(30) Foreign Application Priority Data

Dec. 25, 1997 (IL) ..... 122770

(51) Int. Cl.[7] ..... A01G 27/00; B67D 5/02; B05B 1/30

(52) U.S. Cl. ..... 239/70; 239/72; 239/73; 239/573

(58) Field of Search ..... 239/67, 70, 72, 239/73, 376, 350, 379, 573; 222/1, 23, 55, 52, 71, 509, 544, 505, 214, 638

(56) References Cited

U.S. PATENT DOCUMENTS

| | | | |
|---|---|---|---|
| 252,519 | A | 1/1882 | Righter et al. |
| 402,921 | A | 5/1889 | Gordon |
| 624,733 | A | 5/1899 | Barnikel |
| 752,695 | A | 2/1904 | Martin |
| 824,441 | A | 6/1906 | Scales |
| 857,463 | A | 6/1907 | Irwin |
| 976,992 | A | 11/1910 | Effantin et al. |

(List continued on next page.)

FOREIGN PATENT DOCUMENTS

| | | |
|---|---|---|
| CA | 1020130 | 11/1977 |
| DE | 2833770 | 2/1979 |
| DE | 3209698 | 3/1983 |
| FR | 1145922 | 5/1957 |
| FR | 2618049 | 1/1989 |
| GB | 335320 | 9/1930 |
| GB | 691669 | 5/1953 |
| GB | 1021586 | 3/1966 |
| GB | 1121276 | 7/1968 |
| GB | 1123923 | 8/1968 |
| GB | 1424697 | 2/1976 |
| GB | 1426583 | 3/1976 |
| GB | 1443346 | 7/1976 |
| GB | 1449448 | 9/1976 |
| GB | 1502008 | 2/1978 |
| GB | 1598372 | 9/1981 |
| GB | 2080111 | 2/1982 |
| GB | 2119449 | 11/1983 |
| GB | 2248888 | 4/1992 |

*Primary Examiner*—Henry C. Yuen
*Assistant Examiner*—Davis Hwu
(74) *Attorney, Agent, or Firm*—Pillsbury Winthrop LLP

(57) ABSTRACT

A dispenser for attachment to a container containing a fluid material, including an actuator which keeps the container in a substantially constantly open configuration so as to allow the fluid to pass into the dispenser, and a controllable outlet, through which a portion of the fluid is emitted from the dispenser, substantially independent of the fluid pressure in the container.

51 Claims, 12 Drawing Sheets

U.S. PATENT DOCUMENTS

| | | | |
|---|---|---|---|
| 1,037,680 | A | 9/1912 | Spitzenberg |
| 1,099,720 | A | 6/1914 | Peck |
| 1,241,232 | A | 9/1917 | Macy |
| 1,560,689 | A | 11/1925 | Holt |
| 1,573,879 | A | 2/1926 | Still |
| 1,606,245 | A | 9/1926 | Lang |
| 1,683,760 | A | 10/1928 | Conners |
| 1,703,359 | A | 2/1929 | Paasche |
| 1,723,476 | A | 8/1929 | Everitt |
| 1,815,729 | A | 7/1931 | Armstrong |
| 1,938,036 | A | 12/1933 | Martin et al. |
| 1,938,219 | A | 12/1933 | Eckerbom |
| 1,942,947 | A | 1/1934 | Strange |
| 1,991,720 | A | 2/1935 | Barreda et al. |
| 2,047,973 | A | 7/1936 | Lawton |
| 2,050,609 | A | 11/1936 | Howell |
| 2,070,167 | A | 2/1937 | Iddings |
| 2,075,266 | A | 3/1937 | Bowman |
| 2,097,585 | A | 11/1937 | Carson |
| 2,183,639 | A | 12/1939 | Burdick et al. |
| 2,251,734 | A | 8/1941 | Fuld |
| 2,261,080 | A | 10/1941 | Stellhorn |
| 2,281,604 | A | 5/1942 | Smith |
| 2,310,576 | A | 2/1943 | Dodge |
| 2,333,934 | A | 9/1943 | Jacobson |
| 2,337,077 | A | 12/1943 | Woodman |
| 2,351,376 | A | 6/1944 | Ward |
| 2,400,955 | A | 5/1946 | Samel |
| 2,401,391 | A | 6/1946 | Vale et al. |
| 2,412,434 | A | 12/1946 | Thompson |
| 2,575,935 | A | 2/1948 | Westerberg |
| 2,468,369 | A | 4/1949 | Jones |
| 2,496,816 | A | 2/1950 | Schlumbohm |
| 2,514,030 | A | 7/1950 | Coyle et al. |
| 2,518,259 | A | 8/1950 | Stevenson |
| 2,524,590 | A | 10/1950 | Boe |
| 2,524,796 | A | 10/1950 | Higgins |
| 2,534,067 | A | 12/1950 | Rubin |
| 2,554,260 | A | 5/1951 | Mueller |
| 2,583,688 | A | 1/1952 | Dobkin |
| 2,585,368 | A | 2/1952 | Carroll |
| 2,592,024 | A | 4/1952 | Goodroad et al. |
| 2,613,108 | A | 7/1952 | Kraus |
| 2,615,215 | A | 10/1952 | Stangner |
| 2,617,315 | A | 11/1952 | McClelland |
| 2,606,609 | A | 12/1952 | Johnson |
| 2,662,332 | A | 12/1952 | McIntire |
| 2,629,149 | A | 2/1953 | Yaffe |
| 2,647,402 | A | 4/1953 | Ibbott |
| 2,686,944 | A | 2/1954 | Gubelin |
| 2,673,008 | A | 3/1954 | Ryan |
| 2,687,916 | A | 8/1954 | Reynolds |
| 2,693,983 | A | 9/1954 | Howell |
| 2,695,766 | A | 11/1954 | Peltz |
| 2,701,163 | A | 2/1955 | Teller |
| 2,719,432 | A | 4/1955 | Kalle |
| 2,731,230 | A | 1/1956 | Schell |
| 2,732,192 | A | 1/1956 | Johnson |
| 2,736,987 | A | 2/1956 | Tomasovich |
| 2,742,927 | A | 4/1956 | Frumet |
| 2,758,412 | A | 4/1956 | Loibl |
| 2,743,913 | A | 5/1956 | Gundlach |
| 2,746,796 | A | 5/1956 | St. Germain |
| 2,768,771 | A | 10/1956 | Beutel |
| 2,778,543 | A | 1/1957 | Urlaub |
| 2,782,748 | A | 2/1957 | Zegarowitz |
| 2,795,799 | A | 6/1957 | Dickerman |
| 2,811,328 | A | 10/1957 | Ericson |
| 2,815,889 | A | 12/1957 | Stetz et al. |
| 2,822,002 | A | 2/1958 | Mack |
| 2,830,528 | A | 4/1958 | Arnett |
| 2,835,417 | A | 5/1958 | Kiraly |
| 2,837,375 | A | 6/1958 | Efford |
| 2,838,208 | A | 6/1958 | Levit |
| 2,888,173 | A | 5/1959 | Levit |
| 2,894,478 | A | 7/1959 | Reed |
| 2,900,139 | A | 8/1959 | Hensley |
| 2,904,223 | A | 9/1959 | Ryan |
| 2,913,154 | A | 11/1959 | Kuffer |
| 2,914,222 | A | 11/1959 | Meshberg |
| 2,928,573 | A | 3/1960 | Edelstein |
| 2,930,513 | A | 3/1960 | Zaleski |
| 2,937,789 | A | 5/1960 | Tama |
| 2,948,436 | A | 8/1960 | Federighi |
| 2,961,129 | A | 11/1960 | Bullock |
| 2,967,643 | A | 1/1961 | Edelstein |
| 2,971,382 | A | 2/1961 | Harris |
| 2,991,817 | A | 7/1961 | Ward |
| 2,993,624 | A | 7/1961 | Crist |
| 2,995,278 | A | 8/1961 | Clapp |
| 3,001,672 | A | 9/1961 | Wahl |
| 3,003,704 | A | 10/1961 | Roche |
| 3,007,080 | A | 10/1961 | Benson |
| 2,991,912 | A | 11/1961 | Thomas |
| 3,018,056 | A | 1/1962 | Montgomery |
| 3,055,560 | A | 9/1962 | Meshberg |
| 3,058,629 | A | 10/1962 | Gawthrop |
| 3,093,979 | A | 6/1963 | Ehrens |
| 3,104,785 | A | 9/1963 | Beard |
| 3,107,860 | A | 10/1963 | Umbright |
| 3,115,277 | A | 12/1963 | Montegue |
| 3,117,700 | A | 1/1964 | Gorman |
| 3,127,060 | A | 3/1964 | Vosbikian |
| 3,129,855 | A | 4/1964 | Malakoff et al. |
| 3,132,767 | A | 5/1964 | Gardner |
| 3,134,191 | A | 5/1964 | Davis |
| 3,137,416 | A | 6/1964 | Shepherd et al. |
| 3,139,218 | A | 6/1964 | Cairelli |
| 3,148,515 | A | 9/1964 | Jentis |
| 3,150,800 | A | 9/1964 | Weber |
| 3,158,081 | A | 11/1964 | Frost |
| 3,165,238 | A | 1/1965 | Wiley |
| 3,169,677 | A | 2/1965 | Focht |
| 3,171,245 | A | 3/1965 | Breed |
| 3,178,070 | A | 4/1965 | Leland |
| 3,178,075 | A | 4/1965 | Riedl et al. |
| 3,180,358 | A | 4/1965 | Cogdell |
| 3,180,535 | A | 4/1965 | Ward |
| 3,184,118 | A | 4/1965 | Webster |
| 3,182,857 | A | 5/1965 | Bischoff |
| 3,183,318 | A | 5/1965 | De Poray |
| 3,187,948 | A | 6/1965 | Hunt |
| 3,187,949 | A | 6/1965 | Mangel |
| 3,191,809 | A | 6/1965 | Schultz et al. |
| 3,194,450 | A | 7/1965 | Van Brocklin |
| 3,195,777 | A | 7/1965 | Hart |
| 3,199,732 | A | 8/1965 | Strachan |
| 3,203,594 | A | 8/1965 | Jones |
| 3,204,389 | A | 9/1965 | Genua |
| 3,211,349 | A | 10/1965 | Prussin et al. |
| 3,214,061 | A | 10/1965 | Mills |
| 3,214,062 | A | 10/1965 | Mahon |
| 3,216,618 | A | 11/1965 | Hunter |
| 3,228,609 | A | 1/1966 | Edelstein |
| 3,235,135 | A | 1/1966 | Robert et al. |
| 3,237,036 | A | 3/1966 | Micallef |
| 3,240,390 | A | 3/1966 | Mitchell |
| 3,241,713 | A | 3/1966 | Clapp |
| 3,246,809 | A | 4/1966 | Ward |
| 3,269,601 | A | 8/1966 | Weber, III |
| 3,272,392 | A | 9/1966 | Meshberg |

3,273,752 A 9/1966 Horeczky
3,278,086 A 10/1966 Clouzeau
3,282,294 A 11/1966 Corniello
3,260,421 A 12/1966 Rabussier
3,289,886 A 12/1966 Goldsholl
3,297,254 A 1/1967 Coffman
3,313,459 A 4/1967 Mizuquchi
3,318,159 A 5/1967 Cielaszyk
3,326,418 A 6/1967 Kropp
3,329,314 A 7/1967 Kolodziej
3,330,481 A 7/1967 Dearling
3,351,240 A 11/1967 Gray
3,358,299 A 12/1967 Maude
3,359,063 A 12/1967 Maude
3,360,165 A 12/1967 Iketani
3,368,717 A 2/1968 Weber
3,371,900 A 3/1968 Jacobs
3,377,004 A 4/1968 Kjelson
3,388,834 A 6/1968 Hart
3,397,646 A 8/1968 Allsopp
3,398,863 A 8/1968 Kolodziej
3,411,670 A 11/1968 Mangel
3,419,189 A 12/1968 Iketani
3,420,445 A 1/1969 Inzerill
3,430,219 A 2/1969 Powers
3,455,485 A 7/1969 Crownover
3,456,455 A 7/1969 Sapir
3,477,613 A 11/1969 Mangel
3,477,679 A 11/1969 Lovitz
3,497,108 A 2/1970 Blumle
3,517,667 A 6/1970 Rabbin et al.
3,519,171 A 7/1970 Kinnavy
3,538,520 A 11/1970 Leavitt
3,541,122 A 11/1970 Klebanoff
3,542,248 A 11/1970 Mangel
3,543,122 A 11/1970 Klebanoff et al.
3,544,258 A 12/1970 Presant et al.
3,575,640 A 4/1971 Ishikawa
3,584,766 A 6/1971 Hart
3,587,332 A 6/1971 Bell
3,589,562 A 6/1971 Buck
3,589,563 A 6/1971 Carragan
3,590,594 A 7/1971 Arend
3,592,069 A 7/1971 Welch
3,596,800 A 8/1971 Iketani
3,615,041 A 10/1971 Bischoff
3,617,739 A 11/1971 Dolac
3,627,176 A 12/1971 Sailors
3,633,881 A 1/1972 Yurdin
3,643,624 A 2/1972 Eng
3,643,836 A 2/1972 Hunt
3,647,116 A 3/1972 Hunt
3,648,474 A 3/1972 Moline
3,650,435 A 3/1972 Kleefeld
3,656,657 A 4/1972 Smith et al.
3,658,209 A 4/1972 Freeman
3,666,144 A * 5/1972 Winder ..... 222/70
3,667,502 A 6/1972 Otto
3,668,716 A 6/1972 O'Hara
3,669,352 A 6/1972 Zaphiriz
3,675,254 A 7/1972 Brownstein
3,675,360 A 7/1972 Pierce
3,677,441 A 7/1972 Nixon
3,680,739 A 8/1972 Karr
3,684,133 A 8/1972 Iketani
3,685,693 A 8/1972 Iketani
3,722,749 A 3/1973 Ishida
3,726,437 A 4/1973 Siegel
3,737,104 A 6/1973 Schnieder
3,739,144 A 6/1973 Janson
3,739,944 A * 6/1973 Rogerson ..... 222/70
3,756,465 A 9/1973 Meshberg
3,756,472 A 9/1973 Vos
3,768,104 A 10/1973 Sanderson
3,768,732 A 10/1973 Curtis et al.
3,779,425 A 12/1973 Werner
3,785,537 A 1/1974 Appleby et al.
3,788,550 A 1/1974 Nishiguchi
3,790,081 A 2/1974 Thornton
3,794,216 A 2/1974 Buck
3,794,791 A 2/1974 Thomson
3,801,015 A 4/1974 Hayes
3,804,592 A 4/1974 Garbe
3,837,532 A 9/1974 Sahajian
3,848,775 A 11/1974 Possell
3,851,146 A 11/1974 Bennett
3,861,350 A 1/1975 Selleck
3,869,815 A 3/1975 Bullock
3,874,007 A 4/1975 Dolan
3,881,321 A 5/1975 Riley
3,889,881 A 6/1975 Cunningham
3,893,597 A 7/1975 Ewald
3,908,905 A 9/1975 Philipp et al.
3,949,241 A 4/1976 Maute
3,952,339 A 4/1976 Baur
3,952,916 A 4/1976 Phillips
3,968,905 A 7/1976 Pelton
3,972,473 A 8/1976 Harrison
3,974,941 A 8/1976 Mettler
3,990,844 A 11/1976 Corris
3,993,444 A 11/1976 Brown
RE29,117 E 1/1977 Sahajian
4,006,811 A 2/1977 Corris
4,007,755 A 2/1977 Lerner
4,023,376 A 5/1977 Onodera
4,035,451 A 7/1977 Tringali
4,063,644 A 12/1977 Meetze
4,065,261 A 12/1977 Fukada
4,077,542 A 3/1978 Petterson
4,084,732 A 4/1978 Dearling
4,098,853 A 7/1978 Brown
4,114,515 A 9/1978 Pauliukonis
4,129,432 A 12/1978 Garside
4,142,652 A 3/1979 Platt
4,154,378 A 5/1979 Paoletti et al.
4,159,790 A 7/1979 Bailey
4,161,289 A 7/1979 Rebold
4,162,765 A 7/1979 Riccio
4,166,087 A 8/1979 Cline
4,171,092 A 10/1979 Ragsdale
4,171,754 A 10/1979 Rosado
4,184,612 A 1/1980 Freyre
4,198,574 A 4/1980 Price
4,223,804 A * 9/1980 Morris et al. ..... 222/3
4,225,057 A 9/1980 Horn
4,235,373 A 11/1980 Clark
4,238,055 A 12/1980 Staar et al.
4,247,070 A * 1/1981 Dirksing ..... 248/226.5
4,268,285 A 5/1981 Mason
4,271,092 A 6/1981 Sullivan
4,276,236 A 6/1981 Sullivan
4,294,778 A 10/1981 DeLuca
4,301,095 A 11/1981 Mettler
4,326,648 A 4/1982 Kieber
4,331,262 A 5/1982 Snyder
4,361,013 A 11/1982 Skeele
4,370,300 A 1/1983 Mori
4,383,951 A 5/1983 Palson
4,398,654 A 8/1983 Pong et al.
4,404,923 A 9/1983 Smith
4,407,585 A 10/1983 Hartford
4,415,797 A 11/1983 Choustoulakis 4,418,846 A 12/1983 Pong et al.
4,433,797 A 2/1984 Galia
4,469,255 A 9/1984 Hill
4,483,466 A 11/1984 Gutierrez
4,501,409 A 2/1985 Hill et al.
4,512,587 A 4/1985 Burke et al.
4,530,450 A 7/1985 Nadagiri
4,544,066 A 10/1985 Koppensteiner
4,544,086 A 10/1985 Hill
4,546,905 A 10/1985 Nadagiri et al.
4,552,163 A 11/1985 Biancalana et al.
4,572,406 A 2/1986 Pratt et al.
4,573,804 A 3/1986 Kavoussi
4,601,886 A 7/1986 Hudgins
4,611,641 A 9/1986 Carter, Sr.
4,627,176 A 12/1986 Brieu
4,640,101 A 2/1987 Johnson
4,645,094 A 2/1987 Acklin et al.
4,658,985 A 4/1987 Madson
4,670,010 A 6/1987 Dragone
4,688,585 A 8/1987 Vetter
4,698,620 A 10/1987 Marshall
4,707,338 A 11/1987 Spector
4,719,851 A 1/1988 Chesnut
4,722,372 A 2/1988 Hoffman et al.
4,736,871 A 4/1988 Luciani
4,743,406 A 5/1988 Steiner
4,763,805 A 8/1988 Strock
4,817,651 A 4/1989 Crisp et al.
4,817,822 A 4/1989 Rand
4,830,791 A 5/1989 Muderlak
4,838,456 A 6/1989 Hamlin
4,921,150 A 5/1990 Lagergren et al.
4,925,495 A 5/1990 Crisp et al.
4,935,224 A 6/1990 Russo et al.
4,937,892 A 7/1990 Syrenne
4,946,070 A 8/1990 Albert et al.
4,967,935 A 11/1990 Celeste
4,978,072 A * 12/1990 Kurowski ..... 239/346
4,984,306 A 1/1991 Sumerix
5,012,961 A 5/1991 Madsen
5,024,355 A 6/1991 Jouillat et al.
5,025,962 A 6/1991 Renfro
5,038,972 A 8/1991 Muderlak et al.
5,040,106 A 8/1991 Maag
5,048,721 A 9/1991 Gittens et al.
5,055,822 A 10/1991 Campbell et al.
5,059,187 A 10/1991 Sperry et al.
5,060,164 A 10/1991 Shaw
5,062,164 A 11/1991 Lee et al.
5,074,520 A 12/1991 Lee et al.
5,082,149 A 1/1992 Cross
5,085,401 A 2/1992 Botting
5,095,941 A 3/1992 Betz
5,105,992 A 4/1992 Fender et al.
5,111,477 A 5/1992 Muderlak
5,115,940 A 5/1992 Friedman
5,126,078 A 6/1992 Steiner
5,143,288 A 9/1992 Kohler et al.
5,170,514 A 12/1992 Weigert
5,175,791 A 12/1992 Muderlak
5,199,118 A 4/1993 Cole et al.
5,224,509 A 7/1993 Tanaka et al.
5,249,718 A 10/1993 Muderlak
5,271,560 A 12/1993 De Winter
5,284,133 A 2/1994 Burns
5,299,425 A 4/1994 Hingst
5,301,873 A 4/1994 Burke
5,337,957 A 8/1994 Olson
5,364,028 A 11/1994 Wozniak
5,370,829 A 12/1994 Kunze
RE34,847 E 2/1995 Muderlak
5,395,568 A 3/1995 Chadwick
5,397,028 A * 3/1995 Jesadanont ..... 222/1
5,447,273 A 9/1995 Wozniak
5,449,117 A 9/1995 Muderlak et al.
5,520,310 A 5/1996 Bauer et al.
5,660,330 A 8/1997 Scott
5,677,283 A 10/1997 Doll et al.
5,711,164 A 1/1998 Slack
5,772,074 A 6/1998 Dial
5,842,307 A * 12/1998 May ..... 47/1.7
5,853,122 A 12/1998 Caprio
5,890,655 A 4/1999 Collias et al.
5,895,318 A 4/1999 Smrt
5,927,603 A 7/1999 McNabb

* cited by examiner

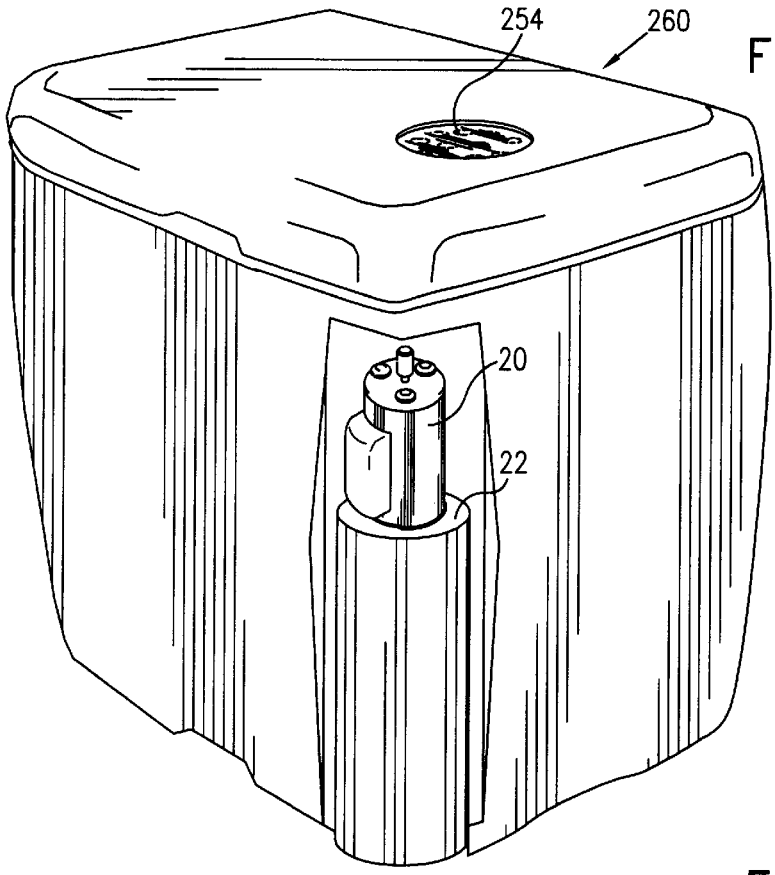
FIG. 14
FIG. 15
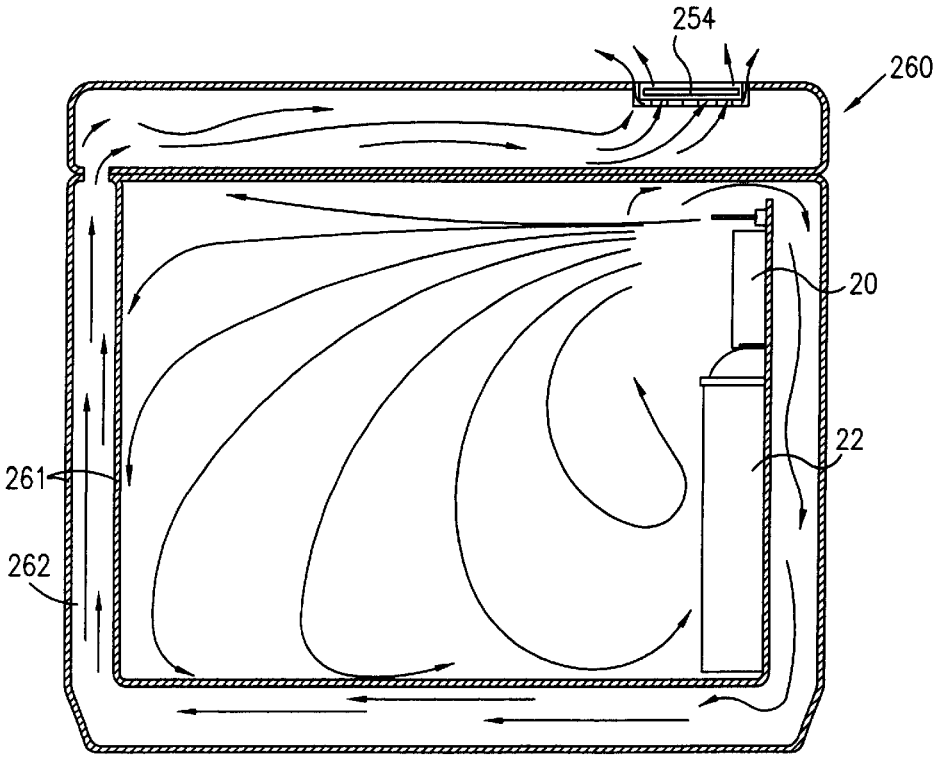

AUTOMATIC SPRAY DISPENSER

FIELD OF THE INVENTION

The present invention relates generally to the field of spray dispensers, and specifically to electric-powered automatic dispensers.

BACKGROUND OF THE INVENTION

Certain products such as insecticides and air fresheners are commonly supplied in pressurized containers. The contents of the container are usually dispensed to the atmosphere by pressing down on a valve at the top of the container. The contents of the container are consequently emitted through a channel in the valve.

In many cases it is desired that the contents of the container be automatically dispensed periodically. Many automatic dispensers are known in the art.

A first type of automatic dispenser includes dispensers with mechanical means, such as an arm, which periodically presses the valve of the container. Such dispensers are described, for example, in U.S. Pat. Nos. 4,184,612, 3,739,944, 3,543,122, 3,768,732, 5,038,972 and 3,018,056. However, these dispensers cannot accurately control the output of the container, since the valve and the contact of the dispenser with the valve are not accurately controlled by the dispenser. Also these dispensers are generally not portable and are fit for use only with containers of a specific size. The valves are also susceptible to failure because of valve sticking, resulting in complete discharge of the contents of the container within a short period.

Another type of automatic dispenser employs a solenoid, which is periodically energized in order to emit a burst of the contents of the container. Such dispensers are described, for example, in U.S. Pat. Nos. 4,415,797, 3,351,240 and 3,187,949. These dispensers require substantial electrical power, and are dependent on gravity and/or the fluid pressure in the container for successful operation.

A third type of automatic dispenser is described, for example, in U.S. Pat. No. 5,447,273. In this automatic dispenser the pneumatic pressure of the container is used to operate a timing device causing the contents of the container to be periodically dispensed. However, the ability to control the dispensation intervals is complicated and limited due to the pneumatic characteristic of the timing device.

Automatic dispensation from non-pressurized containers is described, for example, in U.S. Pat. No. 5,449,117.

SUMMARY OF THE INVENTION

It is an object of some aspects of the present invention to provide an automatic spray dispenser, which allows accurate control of the amount of discharged material. Therefore, it is possible to use the dispenser with materials which require dispensing in accurate quantities.

It is a further object of some aspects of the present invention to provide an automatic spray dispenser which allows flexibility in setting the frequency of dispensation.

It is yet another object of some aspects of the present invention to provide an automatic spray dispenser which is compatible with a large variety of containers.

It is yet another object of some aspects of the present invention to provide an automatic spray dispenser which is compact and portable.

It is yet another object of some aspects of the present invention to provide an automatic spray dispenser which is operationally reliable.

It is yet another object of some aspects of the present invention to provide an automatic spray dispenser which is of a simple construction.

It is yet another object of some aspects of the present invention to provide an automatic spray dispenser which has low energy consumption.

In accordance with preferred embodiments of the present invention, there is provided a spray dispenser which can be mounted on a large variety of pressurized containers, for dispensing aerosol materials and other fluids. Such containers typically have a built-in valve, which is actuated by being pressed down. The spray dispenser is firmly attached to the container, whereupon the valve of the container is kept constantly open by an actuator.

Preferably, the valve is continuously depressed by a corresponding plunger in the dispenser. Preferably, the plunger is an integral part of the dispenser. Alternatively or additionally, the plunger is a separate unit which accommodates the dispenser to the container. Thus, the valve is held constantly open, but the dispenser prevents the contents of the container from being released. This feature enables the dispenser to operate substantially independently of any particular characteristics of the container, and it is possible to employ the dispenser of the present invention with a large variety of standard and non-standard containers. The dispenser includes an outlet which controllably releases portions of the contents of the container according to predefined or user actuated instructions.

Preferably, the dispenser allows automatic periodic dispensing of the spray. The amount of spray emitted at each period is preferably controlled by setting the time in which the outlet is open.

In some preferred embodiments of the present invention, the dispenser comprises an electric circuit, preferably including a microprocessor, which controls the release of material from the container, according to predetermined settings, preferably set by a user. Preferably, the settings include the interval between dispensations and the duration of each dispensation. Alternatively or additionally, the dispenser includes an operation switch for selecting among constant/periodic/off modes of operation. Further preferably, the dispenser can be programmed to have different frequencies of operation at different times. For example, an insecticide may be dispensed in an office during nights before work days at a first rate, while during nights before holidays the insecticide is dispensed at a second rate.

In some preferred embodiments of the present invention, a photoelectric cell is coupled to the microprocessor, to change the operation mode of the dispenser between day and night modes of operation. The microprocessor may be further coupled to a thermostat, wind sensor or any other required sensors, such as sensors of "MEMS" (Micro-Electro-Mechanical-Systems) technology, so as to operate the dispenser in response thereto. In one such preferred embodiment, the dispenser has a plug for connecting to external sensors and/or remote controls.

In some preferred embodiments of the present invention, the dispenser actively opens and closes the controlled outlet, so that its operation is not dependent on gravity or on the pressure within the container. Thus the dispenser may be positioned in any orientation without causing problems in its operation.

In some preferred embodiments of the present invention, the dispenser has an open state in which a fluid is emitted from the dispenser, and a closed state in which the fluid is prevented from leaving the dispenser. The dispenser substantially does not consume energy during the open and closed states, and consumes energy only during transition between the open and closed states.

In preferred embodiments of the present invention, the dispenser comprises a motor, which applies rotational movement in order to dispense material from the dispenser. The use of rotational, rather than linear, movement generally requires less energy and allows better control of the dispenser. The use of a motor requires energy only when opening and closing the outlet, whereas a solenoid continuously requires energy in order to dispense the material in the container.

Preferably, the dispenser is assembled in a simple manner without use of screws, in order to reduce the cost and skill required for assembly. Further preferably, the dispenser does not include gears or cams, so that accurate sizing and placement is not required in the manufacturing process.

Preferably, the spray dispenser is battery-operated and contains within it batteries which supply operation power. Preferably, the batteries are packed in an easily replaceable battery power pack. Most preferably, the batteries are rechargeable, and may be recharged within the dispenser, while the dispenser is in use, for example, using a car battery, an AC electric supply, a solar power cell or any other suitable power source. Alternatively or additionally, the dispenser may operate directly on power received from a car battery or from an AC electric supply and, preferably, contains a transformer suitable for connecting to a local electric line. In addition to the battery or AC power, or as an alternative thereto, the dispenser may receive power from a solar cell, so that it may be placed in remote areas, without any wired connection and without the necessity of replacing its power supply. In some preferred embodiments of the present invention, the microprocessor has a separate power supply from the power supply of the motor, so that short failures in the main power supply do not erase the time settings of the microprocessor. The power supply of the microprocessor is preferably a miniature battery, such as used for example in electric watches.

In some preferred embodiments of the present invention, the outlet of the dispenser comprises an orifice which allows attachment of a large variety of different orifice heads thereto. Such orifice heads may include nozzles of various dispersion properties, for example, wide-range heads for covering large angles at a close range, long-range orifice heads, and curved orifice heads which preferably turn in response to emission of the spray, to cover a wider area. Other orifice heads may also be used, including moisture heads, illumination heads, whistle heads and flame heads. The orifice heads may have various orifice sizes, including small diameters which may achieve a directional force sufficient to mechanically move an object, such as a switch.

Dispensers in accordance with the present invention may be used in conjunction with containers of a wide variety of materials, including, but not limited to, sterilizers, insecticides, deodorants, smoke absorbents, colored smoke, oil, glue (for example, for use on factory production lines), fuels (which are periodically sprayed into a furnace or engine, for example), gases (including air), paints, fire extinguishers, cleaning materials and water. Whereas prior art dispensers are unsuitable or unsafe to use with certain materials that are considered harmful at large concentrations, such as insecticides, the dispenser of the present invention allows very small quantities of such materials to be dispensed at a high accuracy. This accuracy is achieved partially due to the feature that as the dispenser holds the valve of the container constantly open, the emission of the contents of the container is controlled solely by the dispenser. In addition, the rotational movements of the motor cause the speed at which the dispenser is opened and closed to be fast and precisely defined. Therefore, dispensers in accordance with preferred embodiments of the present invention can be used to dispense insecticides and other materials in rooms occupied by humans, animals or delicate plants, with fewer restrictions than may be required by prior art dispensers.

In preferred embodiments of the present invention, adapters are provided for connecting the dispenser to containers of various sizes, shapes, structures and positions and to containers having valves of various sizes. Preferably, such adapters fit between the valve and the dispenser, forming an airtight connection therebetween. Furthermore, adapters may also be provided for connecting the dispenser to containers which do not have valves of their own.

In some preferred embodiments of the present invention, a hose adapter is used to connect between the container and the dispenser. At one end the hose adapter has a connector which fits the container. The connector may either include a plunger, as described above, which fits on standard valves or any other suitable fitting. On its other end, the adapter has a valve or other fitting for connecting to the dispenser. Use of such a hose adapter allows placement of the dispenser at a high or otherwise inaccessible location, while dispensing material from a large container positioned on a lower surface. Furthermore, the hose adapter may be connected to a multiplicity of containers and/or to a multiplicity of dispensers.

It is noted that the fluid in the containers of preferred embodiments of the present invention may be pre-pressurized or may be pressurized each time it is desired to extract the fluid. For example, the motor of the dispenser may be used to pressurize the contents of the container each time it extracts fluid from the dispenser.

Dispensers in accordance with other preferred embodiments of the present invention may also be utilized to periodically emit accurate amounts of material from non-pressurized containers. For example, such a dispenser may be used to water plants with a water container placed with its orifice facing down. A fertilizer or other nutrient may be mixed with the water, as is known in the art. Alternatively, an air pressure supply or a container of pressurized air or other gas may be used along with a Venturi jet to emit the contents of one or more non-pressurized containers.

Although in the above embodiments the dispenser is described as forming a unit separate from the container, it will be appreciated by those skilled in the art that the dispenser may be designed to fit a specific container or may be formed as part of a container.

There is therefore provided in accordance with a preferred embodiment of the present invention, a dispenser for attachment to a container containing a fluid material, including:

- an actuator which keeps the container in a substantially constantly open configuration so as to allow the fluid to pass into the dispenser; and
- a controllable outlet, through which a portion of the fluid is emitted from the dispenser, substantially independent of the fluid pressure in the container.

Preferably, the fluid material in the container is pressurized or non-pressurized.

Preferably, the size of the emitted portion is controlled by varying an amount of time in which the controllable outlet is in an open state.

Preferably, the dispenser has an open state in which the fluid is emitted from the dispenser, and a closed state in which the fluid is prevented from leaving the dispenser, and the dispenser consumes energy substantially only during transition between the open and closed states.

Preferably, the dispenser includes an electric motor which controls passage of the portion of the fluid through the outlet.

There is further provided in accordance with a preferred embodiment of the present invention, a dispenser for attachment to a container containing a fluid material, including:

an actuator, which keeps the container substantially constantly in an open configuration so as to allow the fluid to pass into the dispenser; and an electric motor, which opens the dispenser so that fluid is emitted therefrom and closes the dispenser to prevent the fluid emission.

Preferably, the motor is battery operated and/or is connected to an electric line.

Further preferably, the motor opens and closes the dispenser by a rotational movement.

Preferably, the container has a valve, and the dispenser has a bore therethrough, which receives the fluid from the valve; the bore including a first part having a first inner diameter and a second part having a second inner diameter, larger than the first inner diameter, wherein the dispenser includes:

a hollow shaft, axially movable within the bore, the shaft having a hole disposed along the length thereof such that when the hole is positioned in the first part of the bore, the fluid does not pass through the shaft, and when the hole is in the second part of the bore, the fluid passes through the shaft and is emitted from the dispenser.

Preferably, the dispenser includes a lever connected to the shaft, such that the shaft is axially moved by the lever.

Further preferably, the dispenser includes a screw which drives the lever, and the lever includes an internal thread for receiving the screw.

Preferably, the outlet includes an orifice through which the material is emitted, and the size of the orifice is not substantially smaller than the size of the hole, so that a gas leaving the container does not expand within the dispenser.

Preferably, the dispenser operates substantially without dependence on gears or cams.

Preferably, the container has a valve and the actuator includes a plunger which depresses the valve. Alternatively or additionally, the actuator includes a hose.

Preferably, the dispenser includes a processor which periodically actuates emission of the fluid.

Further preferably, the dispenser includes a user interface for controlling the operation of the dispenser.

Preferably, the processor is programmed to actuate different emission durations at different times.

Preferably, the dispenser includes an adapter for attaching the dispenser to different types of containers.

There is further provided in accordance with a preferred embodiment of the present invention, a dispensing container including:

a can containing a fluid;

a dispenser head which has an open state in which the fluid is emitted from the can and a closed state in which the fluid is not emitted; and a motor which changes the state of the dispenser head between the open and closed states.

Preferably, the dispenser head has a bore therethrough, which receives the fluid from the can, the bore comprising a first part having a first inner diameter and a second part having a second inner diameter, larger than the first inner diameter, wherein the dispenser head includes:

a hollow shaft, axially movable within the bore, the shaft having a hole disposed along the length thereof such that when the hole is positioned in the first part of the bore, the fluid does not pass through the shaft, and when the hole is in the second part of the bore, the fluid passes through the shaft and is emitted from the dispenser head.

Preferably, the dispenser is portable.

In a preferred embodiment, the fluid is dispensed to water a plant.

In other preferred embodiments, the fluid includes a deodorant, an insecticide, and/or a smoke-producing material.

In a preferred embodiment, the dispenser includes a horn mounted on the dispenser so as to make a sound when the fluid is emitted.

Preferably, the fluid is emitted as an aerosol.

Preferably, the dispenser includes a hanger for hanging the dispenser such that the dispenser is free to turn. There is further provided in accordance with a preferred embodiment of the present invention, a cooling device including:

an insulating case;

a pressurized gas container; and a dispenser, arranged to periodically emit the gas from the container into the case in order to cool the interior of the case.

Preferably, the device includes a one-way valve for emitting excess gas from the case.

Preferably, the excess gas emitted from the case includes gas that is generally warmer than an average temperature of the gas in the case.

Preferably, the excess gas emitted from the case includes gas that has been in the case for a generally longer period than most of the gas in the case.

Preferably, the insulating case includes passages and the gas emitted from the container leaves the case substantially only through the passages.

Preferably, the dispenser is fixed to the container such that the container is in a substantially constantly open position, allowing the gas to pass into the dispenser, and the dispenser emits the gas substantially independently of the gas pressure in the container.

Preferably, the dispenser includes an electric motor which drives the dispenser to emit the gas by rotational movements of the motor.

Preferably, the device includes a thermostat which actuates emission of the gas.

There is further provided in accordance with a preferred embodiment of the present invention, a method for dispensing a material from a container having a valve, including:

fixing a dispenser to the container, such that the dispenser holds the valve in a substantially constantly open position, so as to allow the material to pass into the dispenser; and emitting the material from the dispenser substantially independently of the pressure of the material in the container.

Preferably, fixing the dispenser to the container includes fixing the dispenser to a container containing a pressurized material.

Preferably, the dispenser includes an electric motor, and emitting the material includes actuating the motor so as to cause the material to be emitted.

Further preferably, actuating the motor includes driving a rotational movement using the electric motor.

Preferably, emitting the material includes emitting the material periodically.

Further preferably, emitting the material includes emitting the material at a first rate during a first period and emitting the material at a second rate during a second period.

Alternatively or additionally, emitting the material includes emitting the material in response to an external signal.

Preferably, emitting the material includes emitting the material in response to a signal received from a sensor. Preferably, emitting the material includes emitting an aerosol.

Alternatively or additionally, emitting the material includes emitting a deodorant.

Alternatively, emitting the material includes emitting an insecticide.

Alternatively or additionally, emitting the material includes emitting smoke.

Further alternatively, emitting the material includes watering a plant.

Preferably, the method includes hanging the dispenser such that it is free to turn.

Preferably, emitting the material includes bringing the dispenser from a closed state to an open state in which the material is emitted from the dispenser, and wherein the dispenser consumes energy substantially only during transition between the open and closed states.

There is further provided in accordance with a preferred embodiment of the present invention, a method of maintaining a concentration level of a material within an area including:

receiving a signal from a sensing device, in response to the level of the material in the area; and setting an automatic dispenser mounted on a container of the material to operate responsive to the sensor.

Preferably, setting the dispenser includes setting the dispenser to operate when the level is beneath a predetermined level.

Preferably, the material includes oxygen.

There is further provided in accordance with a preferred embodiment of the present invention, apparatus for maintaining a concentration level of a material within an area, including:

a container containing the material;

a sensor which senses the concentration of the material within the area and generates signals responsive to the concentration; and an automatic dispenser mounted an the container which dispenses the material in response to the signals from the sensor, wherein the apparatus operates substantially independently of any wired or fluid communication with elements other than the sensor, container and dispenser. Preferably, the sensor generates signals responsive to a concentration below a predetermined level.

There is further provided in accordance with a preferred embodiment of the present invention, a method of maintaining a low temperature in a volume including controlling an automatic dispenser to automatically emit a gas from a pressurized gas container into the volume.

Preferably, directing the dispenser includes setting the dispenser to periodically emit the gas.

Alternatively or additionally, directing the dispenser includes directing the dispenser to emit the gas responsive to a temperature sensor.

Preferably, the gas includes air.

Preferably, the method includes emitting excess gas from the volume which is generally warmer than an average temperature of the gas in the volume.

Preferably, the method includes emitting excess gas from the volume which gas has been in the volume generally for a longer period than most of the gas therein.

There is further provided in accordance with a preferred embodiment of the present invention, a method of pest control including:

mounting an automatic dispenser having a horn head on a pressurized gas container; and operating the dispenser automatically to periodically emit a portion of the gas in the container so as to operate the horn.

Preferably, periodically emitting the gas includes emitting gas in response to detection of a pest Preferably, periodically emitting the gas includes emitting gas so as to cause movement disturbing to the pest.

The present invention will be more fully understood from the following detailed description of the preferred embodiments thereof, taken together with the drawings, in which:

BRIEF DESCRIPTION OF THE DRAWINGS

FIG. 14 is a perspective view of a cooler utilizing an automatic dispenser, in accordance with another preferred embodiment of the present invention; and FIG. 15 is a schematic diagram illustrating air flow in the cooler of FIG. 14, in accordance with a preferred embodiment of the present invention.

DETAILED DESCRIPTION OF PREFERRED EMBODIMENTS

Figure 1:
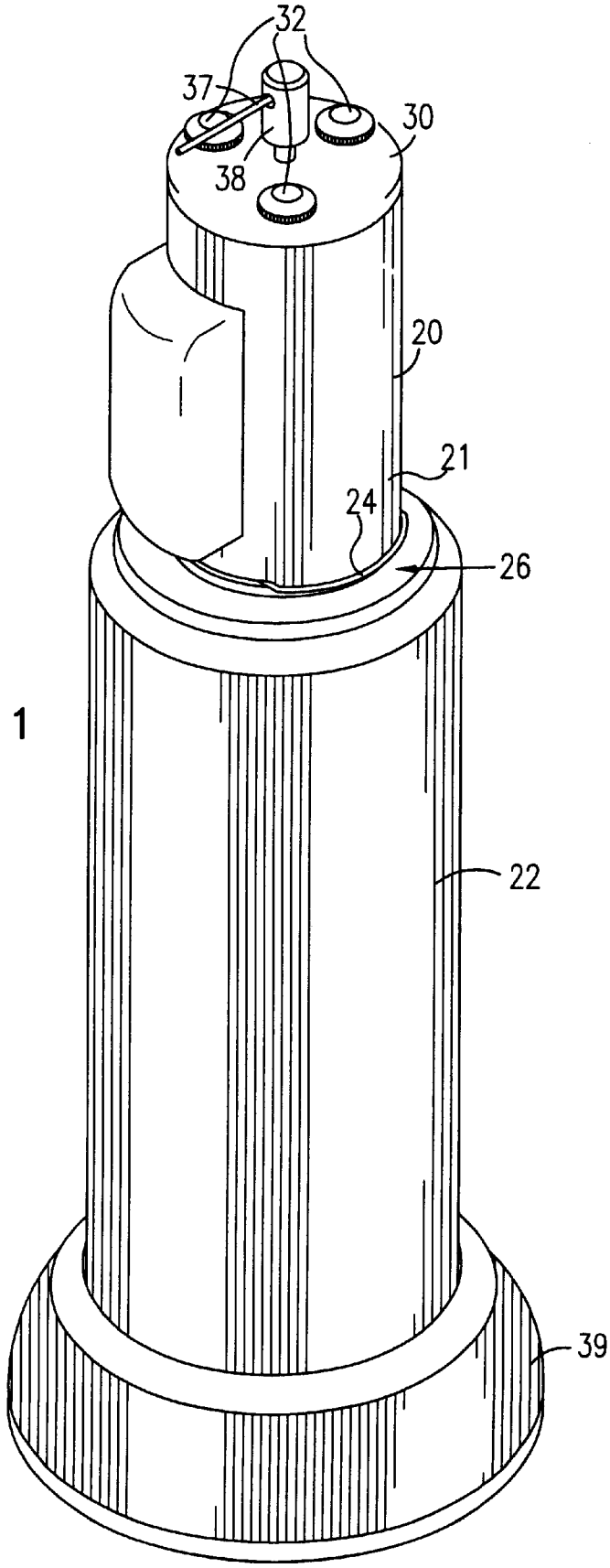
FIG. 1 is a schematic perspective view of an automatic dispenser in operation, attached to a container, in accordance with a preferred embodiment of the present invention.

FIG. 1 shows an automatic dispenser 20 mounted on a pressurized aerosol container 22, in accordance with a preferred embodiment of the present invention. Dispenser 20 dispenses a material held in the container via an orifice head 38, which may include a dispensing tube 37. Dispenser 20 controls the dispensation of the contents, which are preferably dispensed periodically according to user settings. A control panel 30 is preferably situated on a top side of dispenser 20, to receive user settings of the dispenser's operation, including the frequency of dispensations and the duration of each dispensation. Preferably, the frequency of dispensation may be between once every few seconds to once every few days. Alternatively or additionally, dispenser 20 is operated by an external signal originating, for example, from a sensor or a factory line control.

Preferably, dispenser 20 has three switches 32, which allow easy selection of the operation settings by the user. In a preferred embodiment of the present invention, a first switch sets the dispensation duration in tenths of seconds; a second switch selects the units in which the interval between durations is measured, e.g., seconds, minutes, hours, days or weeks; and a third switch sets the length of the interval in the selected units. Preferably, the second switch allows choosing other modes of operation including external control, off, constant and a test mode. It is noted that other controls, including various switches and displays, may also be used to set the dispensation timings, as is known in the art.

In some preferred embodiments of the present invention, a wide base 39 is attached to container 22 when it is to be placed on the ground or on another surface. Base 39 prevents container 22 from moving when the material is dispensed therefrom at a high rate. Alternatively, dispenser 20 may be fixed to a pole or wall to prevent turning thereof, as shown for example in FIG. 2.

Figure 2:
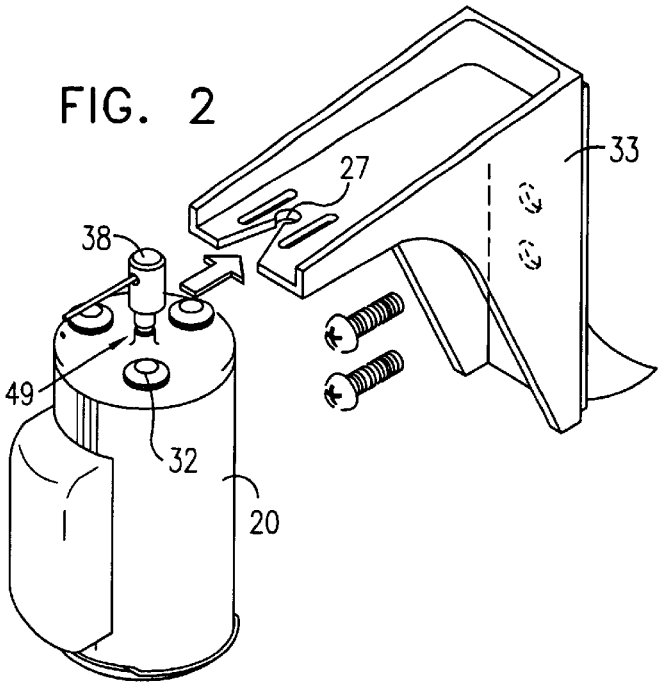
FIGS. 2–4 are schematic perspective views of the dispenser of FIG. 1 with various mounting devices, in accordance with preferred embodiments of the present invention.
Figure 3:
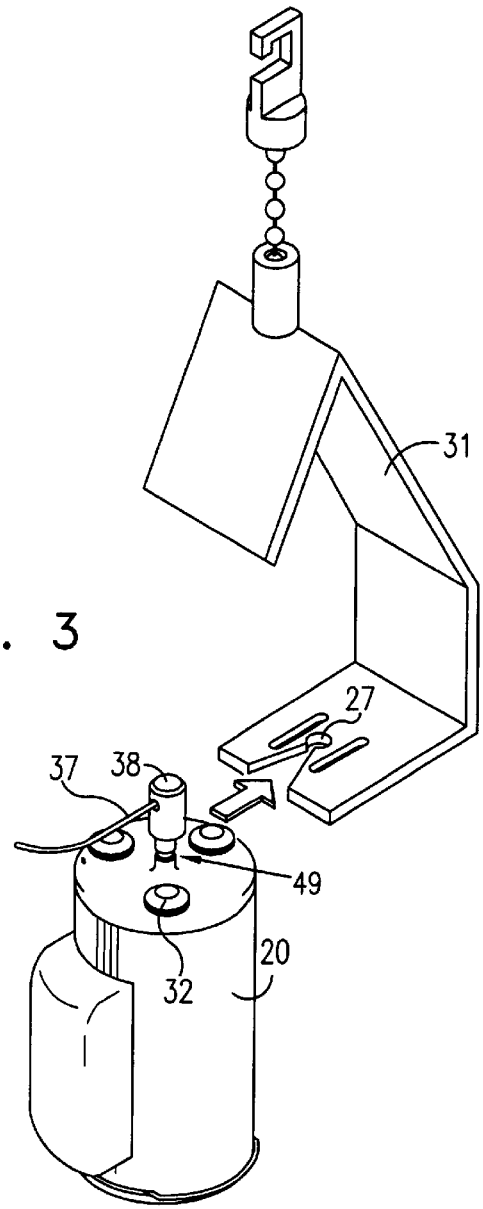
Figure 4:
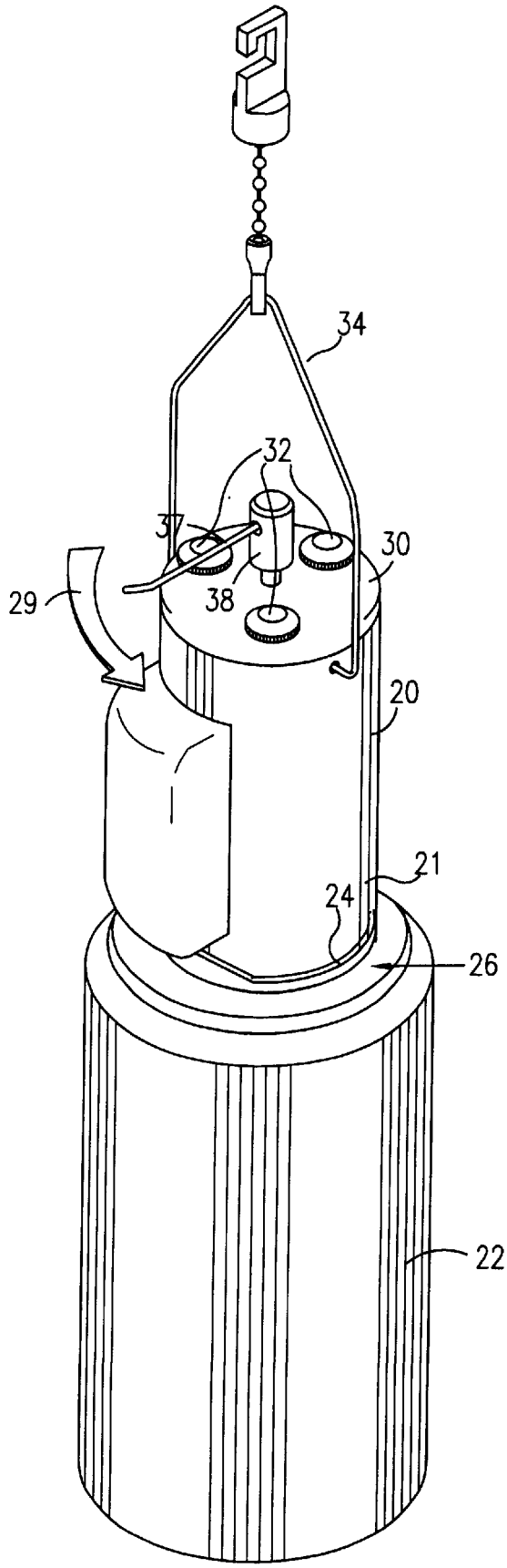

FIGS. 2–4 show dispenser 20 with various mounting devices therefor, in accordance with a preferred embodiment of the present invention. It is noted that other mounting methods may be used, including methods allowing dispenser 20 to rotate in various patterns as applied, for example, in the sprinkler industry.

In a preferred embodiment of the present invention, shown in FIG. 2, dispenser 20 is mounted by a fixed holder 33 having a receiving groove 27 which firmly holds a slit 49 located in dispenser 20 close to orifice head 38. Thus, dispenser 20 is tightly held and prevented from rotating.

FIG. 3 shows another preferred embodiment of the present invention, in which dispenser 20 is mounted on a rotating hanger 31 which rotates together with the dispenser.

In a preferred embodiment of the present invention, shown in FIG. 4, dispenser 20 is hung on a hanger 34 in a manner allowing free turning of the dispenser and container relative to the surroundings. Dispensing tube 37 is bent so that when the contents of container 22 are emitted, dispenser 20 revolves around its axis preferably in the direction of arrow 29, and the contents of the container are distributed all around the dispenser.

It is noted that the methods of mounting dispenser 20 described above are shown by way of example and other accessories may be used, including hooks, and double sided tape depending on the specific purpose for which dispenser 20 is used. Preferably, the accessories allow positioning dispenser 20 at any desired orientation, since dispenser 20 may operate in substantially any orientation due to its independence from gravity and other external forces in emitting the material. The descriptors top, bottom, upper, lower, etc., which are used in the following description, refer therefore solely to the orientation of dispenser 20 shown in the figures and are used throughout this description only for the purpose of simplicity.

Dispenser 20 forms an air-tight sealed connection with container 22, such that the contents of container 22 may be dispensed only through dispenser 20, as described herein. An elastic metal ring 24 at a bottom end 21 of dispenser 20 fits into a groove 26 at the top of container 22, securing the connection. The connection is preferably released by pressing on handles 25 (FIG. 5) at the edges of ring 24. Preferably, the connection is capable of withstanding forces of a magnitude of at least 2–4 kg of force to prevent separation of dispenser 20 from container 22 due to the fluid pressure and or inadvertent external pressure.

When dispenser 20 is in connection with container 22, a plunger, which is preferably an integral part of the bottom of the dispenser, presses on an opening valve 28 of the container, so that the valve is held constantly in the open position. The material in container 22 and the pressure it exerts are thus controlled by dispenser 20, which is compatible with a wide variety of spray containers without dependence on their specific characteristics. Preferably, when mounting dispenser 20 on container 22, the plunger presses on valve 28 only after a leak tight connection is formed between valve 28 and dispenser 20.

The contents of container 22 enter dispenser 20 at bottom 21 of the dispenser, and leave through an orifice 36 (see FIG. 5) at the top of the dispenser. Orifice head 38 is preferably mounted in orifice 36 to direct the contents leaving the dispenser. Orifice head 38 may have a narrow orifice, suitable for long-range dispensing. Preferably, dispensing tube 37 extends from orifice head 38 leading the contents of container 22 to the surroundings of the dispenser. Alternatively, orifice head 38 may have a wide orifice, suitable for covering a large area at a short range. It will be appreciated that various and other orifice heads, as are known in the art, may be used with the dispenser.

Figure 5:
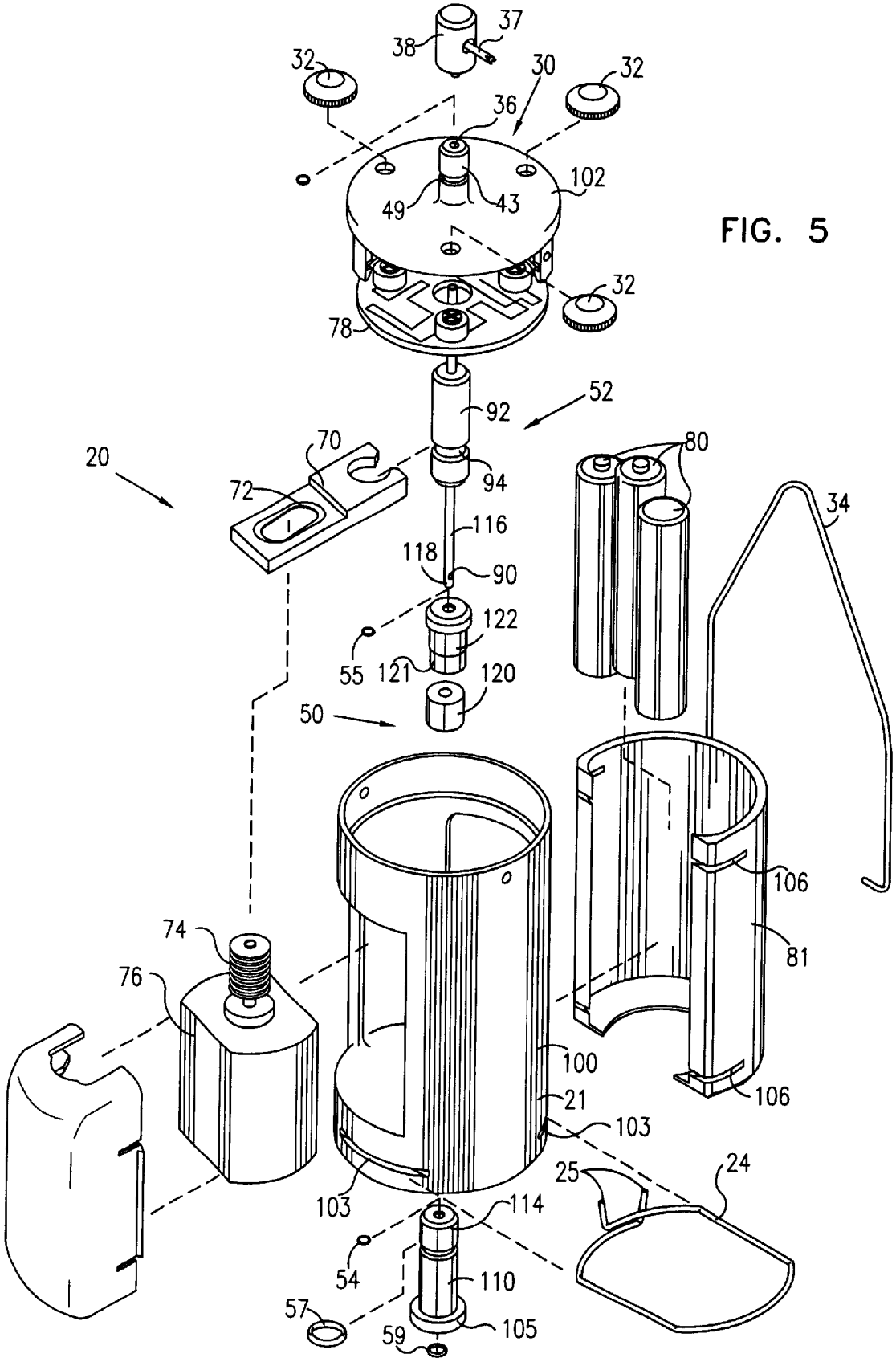
FIG. 5 is an exploded perspective view of the dispenser of FIG. 4.

FIG. 5 shows an exploded view of dispenser 20, in accordance with a preferred embodiment of the present invention. Dispenser 20 comprises a case 100 having a cylindrical shape. Preferably, case 100 has a diameter of about 3.9 cm, and a height of about 10 cm. A top piece 102 containing orifice 36, fits on top of case 100. Preferably a bulge 43 in top piece 102 defines an upper bore 58 (see FIG. 6) which leads to orifice 36. Preferably, two slits 103 are defined in case 100 opposite top piece 102 which are sized and positioned to accept ring 24.

A battery pack 81, preferably comprising three standard batteries, fits into case 100 and supplies power for the operation of dispenser 20. The material from container 22 is conveyed to upper bore 58 and orifice 36 through a lower bore 50 defined by three cylinder bolts 110, 120 and 122, and a shaft 52. Preferably, bore 50 and shaft 52 run along the center of dispenser 20.

Shaft 52 contains a long, hollow core 116, which communicates between bore 50 and bore 58. Core 116 is open at its top end, leading to orifice 36, but is closed at its bottom end 118. At least one hole 90, preferably at least three such holes, leading into a central lumen 104 of hollow core 116, are situated radially near the bottom of core 116, preferably a few millimeters from bottom end 118. An O-ring 55 surrounds and seals core 116 within bore 50, preferably within top bolt 122, and prevents leakage of the material from container 22 into the interior of dispenser 20. An additional O-ring 56 is preferably situated around bore 58 to prevent leakage of the material from the bore to the interior of dispenser 20. Preferably, bolt 122 has a slightly smaller diameter in an area 121 along its length in which it receives O-ring 55, so that external pressure does not cause damage to the ring. Preferably, shaft 52 comprises a thick section 92 for manipulation of the shaft. Thick section 92 connects to a lever 70 which manipulates shaft 52, as is described below.

Figure 6:
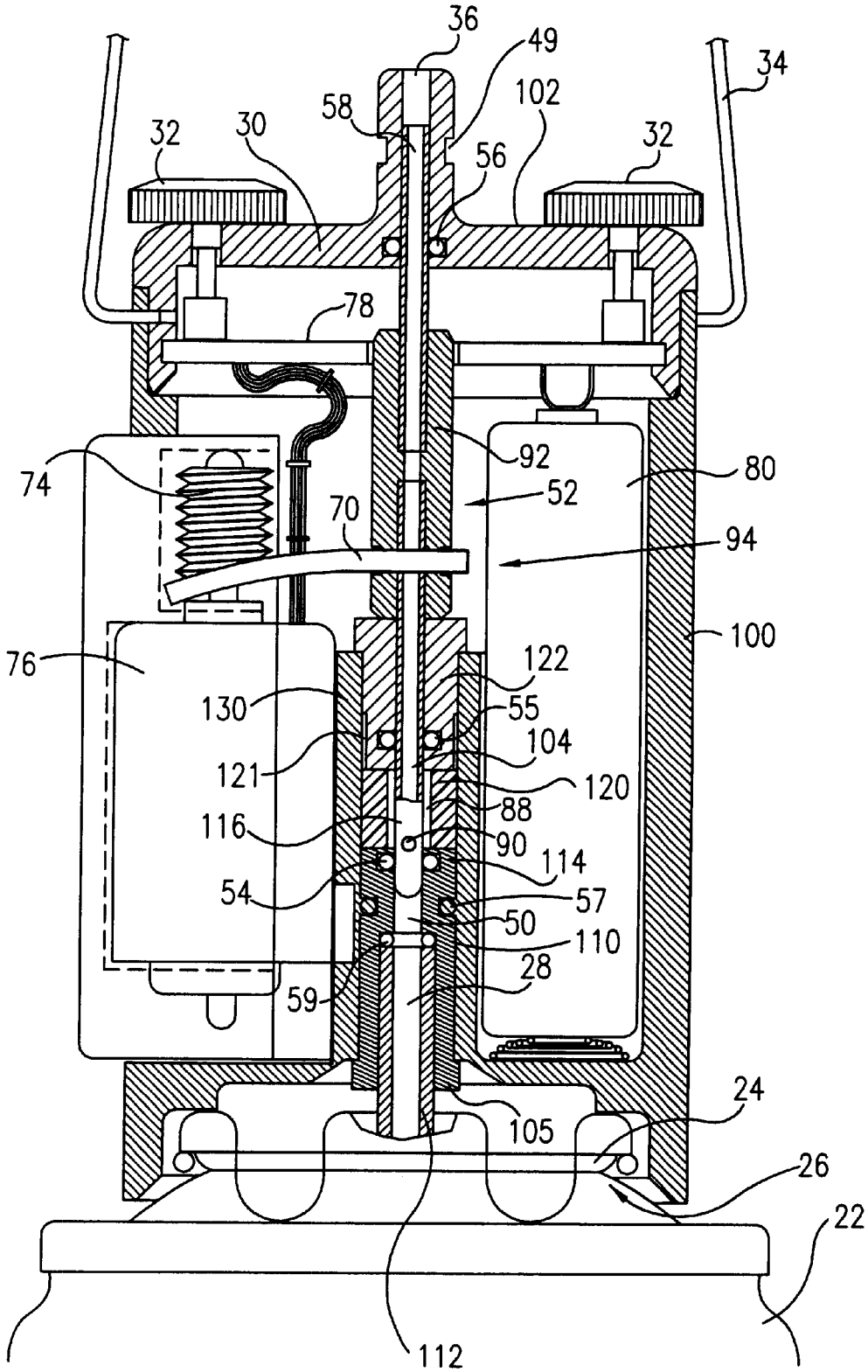
FIG. 6 is a schematic cross-sectional view of the dispenser of FIG. 4 in a closed position.
Figure 7:
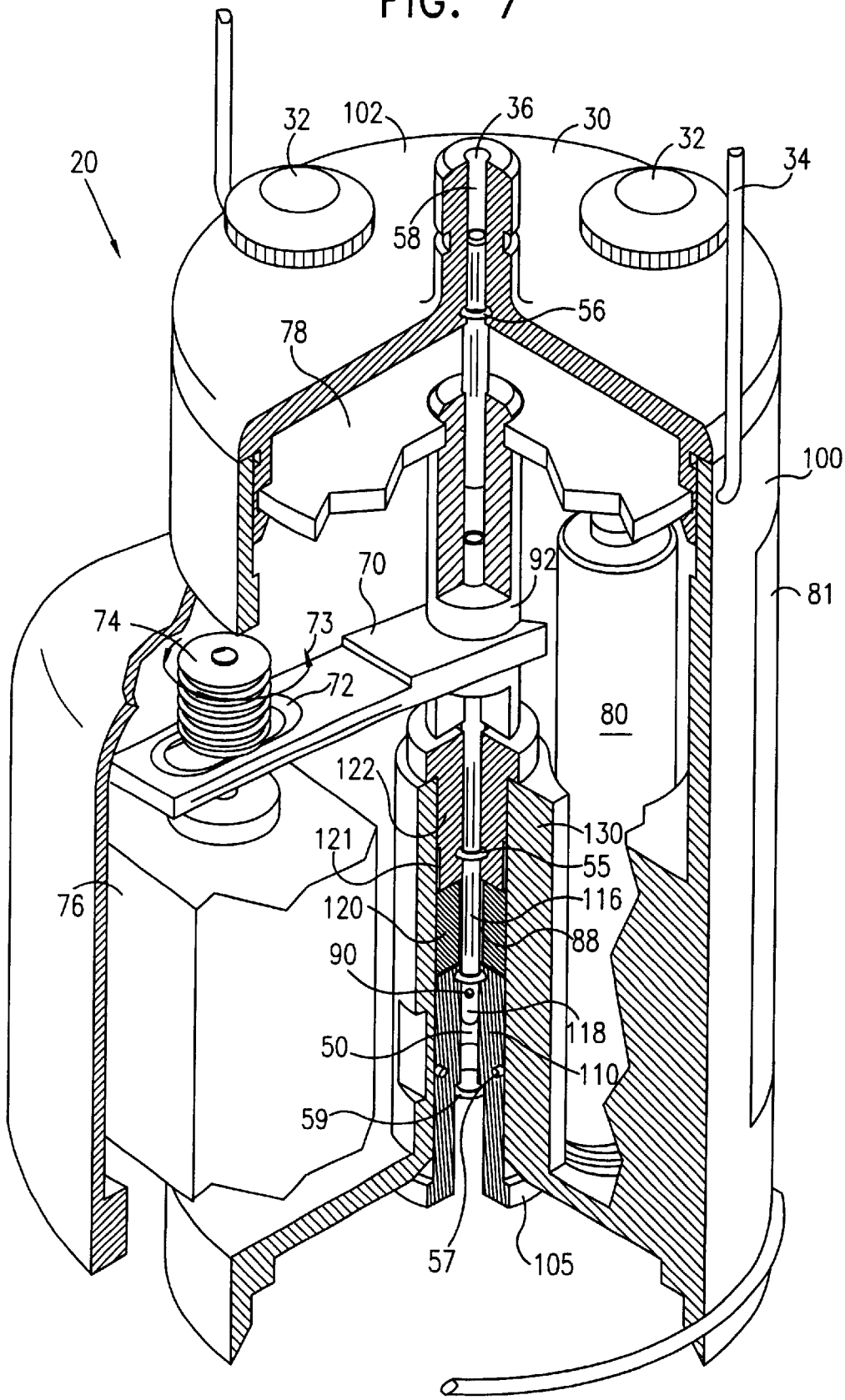
FIG. 7 is a perspective, partly sectional view of the dispenser of FIG. 4, in the closed position.

FIGS. 6 and 7 show dispenser 20 in a closed state, in accordance with a preferred embodiment of the present invention. Bottom bolt 110 of bore 50 serves as the plunger which presses down on valve 28 in order to keep container 22 constantly open. Bottom bolt 110 is shaped and sized to receive valve 28 of container 22 at a lower side 105 of the bolt, such that the contents of the container will flow through valve 28 only into bore 50. In order to accommodate different sizes of valves 28, a replaceable adapter 112 may be used to seal the connection between valve 28 and bolt 110. Alternatively or additionally, bolt 110 may be easily replaced to accommodate the different valves. An O-ring 59 preferably aids in sealing the connection. Preferably, the plunger part of bolt 110 is deep enough within bolt 110 so that valve 28 is pressed only when the valve is sealed within bolt 110. The contents of container 22 enter bore 50 and do not escape due to the tight fit of valve 28 within bolt 110. Bore 50 is blocked at its upper end by bottom end 118 of core 116, which in the closed state is situated within bottom bolt 110. An O-ring 54 aids shaft 52 in preventing the contents of container 22 from passing from bottom bolt 110 to middle bolt 120. Preferably, an upper side 114 of bottom bolt 110 has an inner diameter which tightly receives core 116 of shaft 52.

Top bolt 122 preferably has an inner diameter of about the same size as that of upper side 114 of bottom bolt 110, and likewise prevents leakage of the contents of container 22 when shaft 52 is within the bolt. Preferably, shaft 52 is always held within top bolt 122, although at varying heights, preventing the aerosol from escaping bore 50 through top bolt 122, into case 100.

Middle bolt 120, has an inner diameter larger than the outer diameter of core 116. The larger inner diameter defines a cavity 88 which allows passage of the fluid, as is described below. Thus, the fluid entering bore 50 can exit the bore only through holes 90 into central lumen 104 of shaft 52. However, the fluid enters lumen 104 only when holes 90 are within middle bolt 120, due to the larger inner diameter of bolt 120.

Preferably, bottom bolt 110, middle bolt 120 and top bolt 122 are held within a channel 130 in case 100. Channel 130 keeps the bolts defining bore 50 tightly in place. Preferably, an O-ring 57 prevents bolt 110 from sliding within channel 130. Alternatively or additionally, one or more of bolts 110, 120 and 122 may be formed as an integral part of channel 130.

Lever 70 is connected on one side to section 92 of shaft 52 and on the other side to a screw 74, which is coupled to a motor 76. When dispenser 20 is to be moved between open and closed states, motor 76 rotates screw 74, and lever 70 is moved from one end of screw 74 to the other. Thus, the distance which lever 70 moves together with shaft 52 is determined by the length of screw 74, and there is no need to precisely control the number of turns rotated by motor 76. Precise control of the number of rotations of motor 76 requires relatively expensive apparatus that may be too large for a small dispenser. Stoppers may be used at either end of screw 74 to allow precise control of the distance of movement. The stoppers preferably comprise a suitable non-stick material in order to minimize the possibility of locking of the lever against the stopper.

Preferably, screw 74 is slightly longer than the maximum distance allowed for movement of shaft 52 between the open and closed states. The extra length is compensated for by flexibility of lever 70, which bends slightly and leans on screw 74 at both open and closed states. Alternatively, screw 74 is substantially longer than the allowed distance, and section 92 serves as a stopper and prevents movement beyond the maximum allowed distance, when section 92 meets the lower surface of top piece 102. Preferably, section 92 includes a slot 94 for receiving lever 70. Lever 70 comprises a collar 72, having approximately one turn of an internal thread, which receives screw 74. Alternatively, the side of lever 70 which fits on screw 74 comprises a step the size of about half a turn of a thread of screw 74, which easily fits on the screw. Preferably, collar 72 is flexible and large enough to leave leeway, so as not to require accurate fitting of screw 74 to the collar. In both the closed and open states of dispenser 20, collar 72 is situated at a respective end of screw 74 and exerts a slight bend pressure on the screw. Thus screw 74 reliably enters collar 72, and there is substantially no risk of collar 72 not fitting back on screw 74. Preferably, lever 70 comprises a non-abrasive plastic or any other material having similar characteristics.

Motor 76 preferably comprises a standard DC motor, whose shaft rotates screw 74. Alternatively, motor 76 may operate on AC power. Motor 76 is controlled by a processor 78, which operates according to the user's settings on control panel 30. Processor 78 and motor 76 preferably receive power from batteries 80 within dispenser 20. Alternatively or additionally, dispenser 20 is connected to a local electric line supply. Further alternatively or additionally, processor 78 receives power from a miniature battery separate from the power supply of the motor. As long as motor 76 is not operated, lever 70 does not move and prevents shaft 52 from moving under pressure from container 22.

Figure 8:
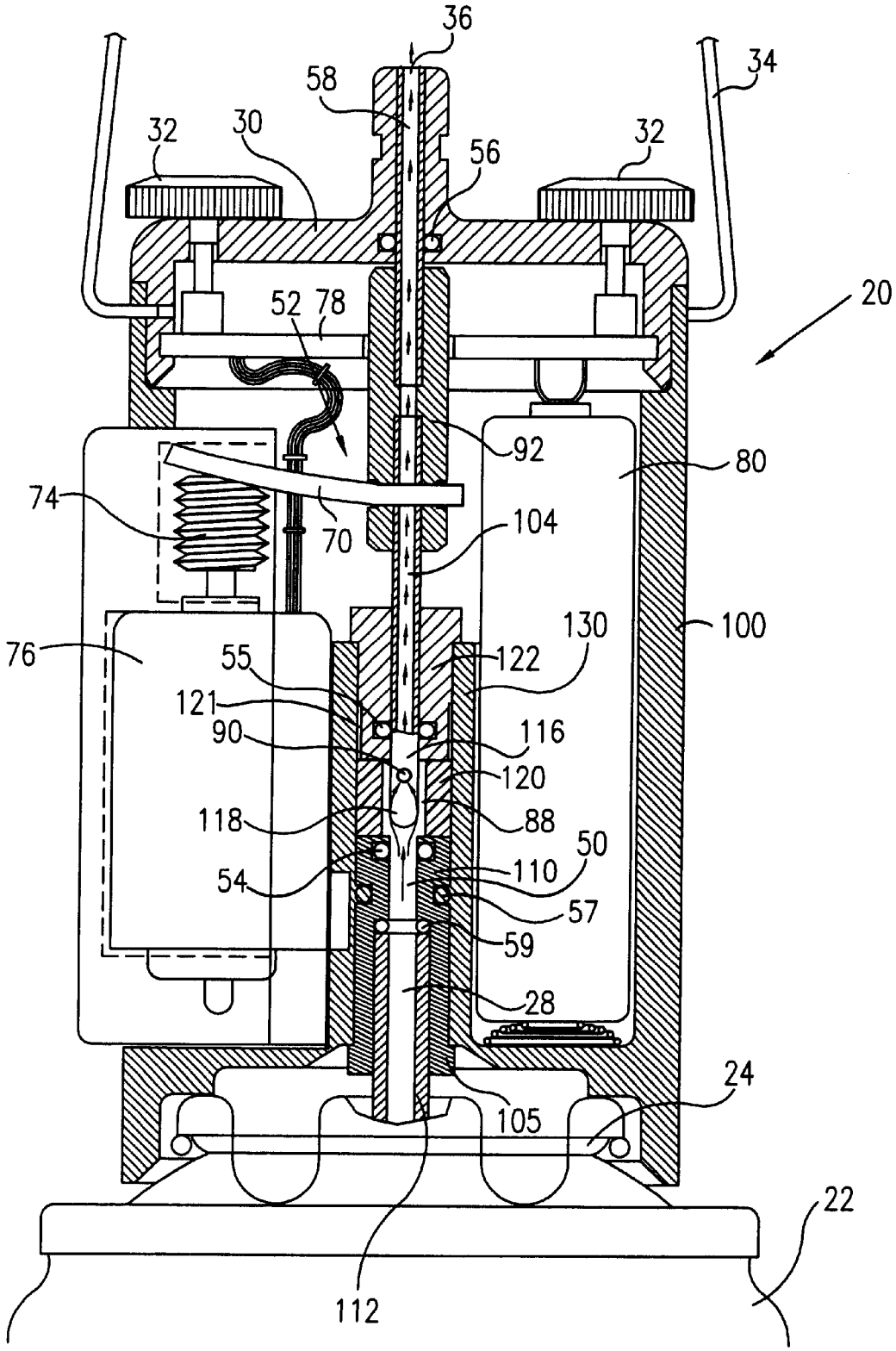
FIG. 8 is a schematic cross-sectional view of the dispenser of FIG. 4 in an open position.
Figure 9:
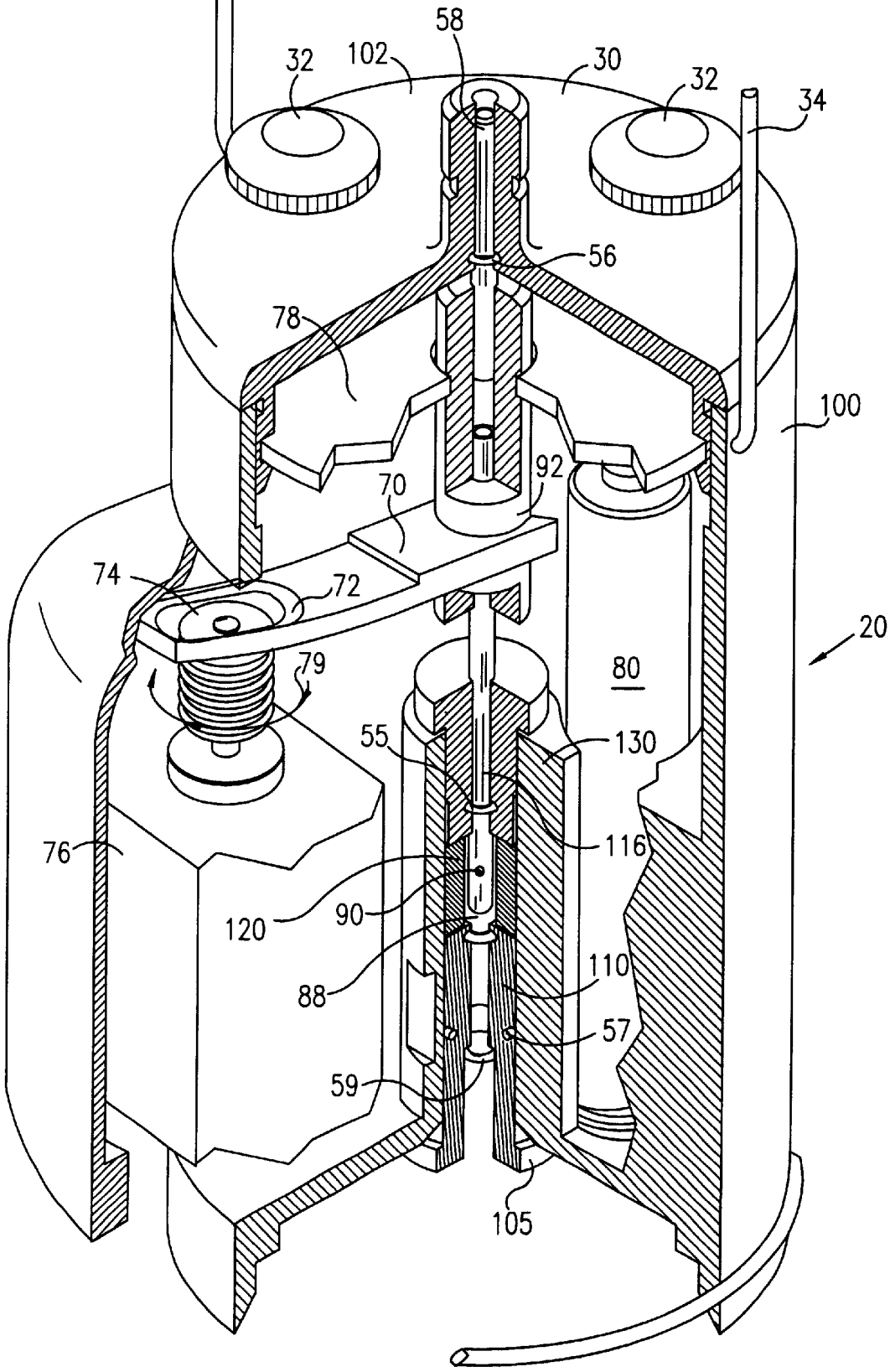
FIG. 9 is a perspective, partly sectional view of the dispenser of FIG. 4 in the open position.

FIGS. 8 and 9 illustrate dispenser 20 in the open position, in accordance with a preferred embodiment of the present invention. When dispenser 20 is to release a spray of aerosol, processor 78 actuates motor 76. Motor 76 rotates screw 74 clockwise (as indicated by an arrow 79) causing lever 70 to elevate relative to screw 74 and reach the top of screw 74. Shaft 52 is lifted by lever 70 such that its bottom end 118 is located within enlarged cavity 88 in bore 50. At this stage, the pressure of container 22 pushes some of its contents into cavity 88. Hole 90 allows the contents to enter hollow shaft 52 and consequently to move out to the atmosphere, through orifice 36 at the top of dispenser 20.

After the spray has been dispensed for a predetermined time, processor 78 actuates counter clockwise operation of motor 76, indicated by an arrow 73, shown in FIG. 7, so as to lower lever 70. Lever 70 pushes shaft 52 back to the closed state shown in FIGS. 6 and 7, and thus hole 90 is resealed in bottom bolt 110. Preferably, the movements of screw 74 from one state to another require less than 0.1 seconds. In the closed state, bent lever 70 aids in prevention of shaft 52 from moving.

The force exerted by the pressure of container 22 on shaft 52 is equal to the cross-sectional area of the inner channel in shaft 52 times the pressure of the container. In a preferred embodiment of the present invention, shaft 52 has an inner diameter of about 1.5 mm and the contents of container 22 are generally pressurized to about 5 atmospheres, so that the force exerted is approximately 90 grams of force. The force required to seal the container is about 0.2 kg of force and the force applied by motor 76 to open/close dispenser 20 is preferably approximately between 0.4–0.5 kgs of force. In comparison pressing on the valve to open the container, would require a force of about 2.5 kgs of force. Thus, dispenser 20 generally consumes much less energy than dispensers known in the art. It is noted that the force applied by motor 76 can be adjusted by changing the length of screw 74 and/or the thickness of lever 70.

The use of rotational movement to move shaft 52 allows the elements of dispenser 20 to be manufactured with relatively low precision. Thus, it is not necessary to use fine mechanical pieces for screw 74 and lever 70. Also, dispenser 20 does not require gears and cams, which complicate the mechanism and require more accurate design and manufacture.

Preferably, hole 90 (or the aggregate of the plurality of such holes) and orifice 36 have approximately the same cross-sectional area. As gas is known to cool upon expansion, this sizing relation will allow gas entering cavity 88 to exit orifice 36 without freezing inside dispenser 20.

Container 22 may contain any of a large variety of liquids or gasses including, for example, air, oxygen, fuels, water, oils, sterilizers, cleaning materials, insecticides and deodorants. It is noted that some poisonous materials and fuels must be emitted in small and accurate amounts in order to prevent damage. Therefore, these materials could not generally be used in prior art dispensers. This limitation is overcome by preferred embodiments of the present invention which emit accurate amounts of material and therefore allow use of these materials.

In the above preferred embodiment, dispenser 20 comprises a plurality of parts which are connected together without requirement of screws. For example, slots 106 in battery pack 81, shown in FIG. 5, facilitate such connection. This embodiment allows easy production and assembling of the dispenser. However, it will be clear to those skilled in the art that the dispenser may comprise fewer or more parts, which may be connected in various manners. For example, as mentioned above, bore 50 may comprise only one piece instead of channel 130, and separate bolts 110, 120, and 122. Also top piece 102 may be manufactured as part of case 100.

In a preferred embodiment of the present invention, not shown in the figures, the orifices of a plurality of dispensers 20 are connected in parallel through a common hose to a single emitting opening. Preferably, dispensers 20 are mounted on containers holding different materials and are operated at the same time, mixing the materials together. Alternatively, the dispensers may have different time settings, such that the same opening emits different materials at different times.

Figure 10:
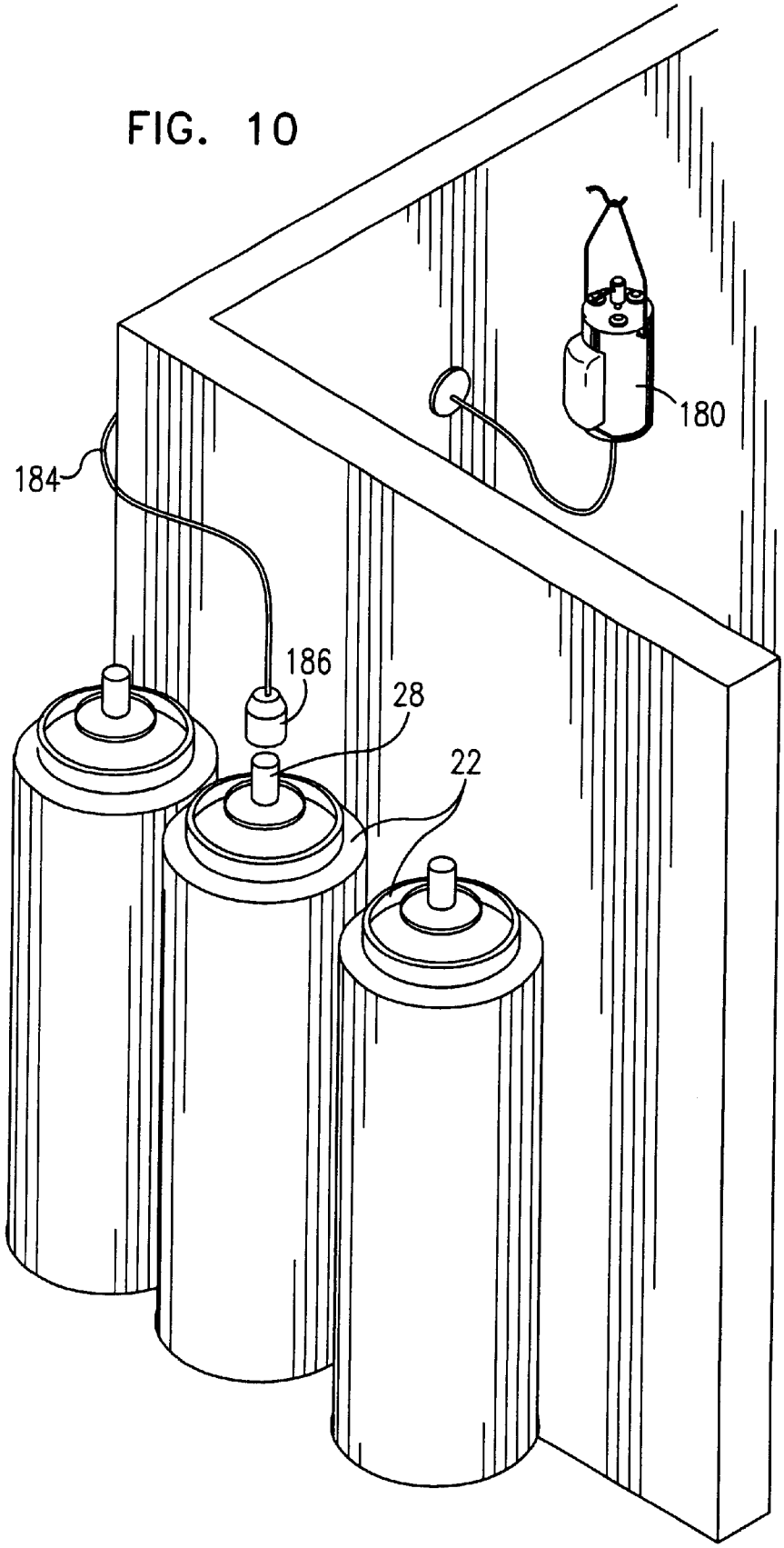
FIG. 10 is a schematic view of a dispenser which operates on a remote container, in accordance with a preferred embodiment of the present invention.

In another preferred embodiment of the present invention, also not shown in the figures, dispenser 20 comprises a refill inlet which allows easy refilling of container 22. FIG. 10 is a schematic illustration showing a dispenser 180, which operates on a remote container 22, in accordance with a preferred embodiment of the present invention. A hose 184 connects between container 22 and dispenser 180. Hose 184 comprises at a first end thereof a connector 186, which engages valve 28 of container 22. Preferably, connector 186 is similar to bottom end 21 of dispenser 20 and may include a ring, similar to ring 24 shown in FIG. 1, which strengthens the connection between hose 184 and container 22. Dispenser 180 is connected to the other end of hose 184 by means of any tube connection known in the art. The use of hose 184 allows the dispenser to be placed in locations where it is not feasible to place container 22. Thus, it is possible to place large containers 22 in a storage area, while only dispenser 180 is placed in a dispensing area. In a preferred embodiment of the present invention, a plurality of dispensers 180 are connected to container 22. Alternatively or additionally, a plurality of containers 22 are connected to one or more dispensers 180 via a single hose 184. Such a set-up provides reliable supply of the contents of container 22 even when one container is empty.

In a preferred embodiment of the present invention, container 22 contains an insecticide, and dispenser 20 is positioned in mosquito habitats, gardens, greenhouses, or any other location where it is desired to periodically spray against insects. Dispenser 20 is set to operate periodically, for example, once a week, to automatically dispense a quantity of insecticide from within container 22. Preferably, dispenser 20 is covered by a protective plastic which protects it from weather hazards. Dispenser 20 is preferably positioned before the appropriate season, and container 22 contains sufficient material so that it is not necessary to return for refilling until the next season. Using automatic insecticide dispensation is especially advantageous in those areas where access is difficult and/or costly.

Figure 11:
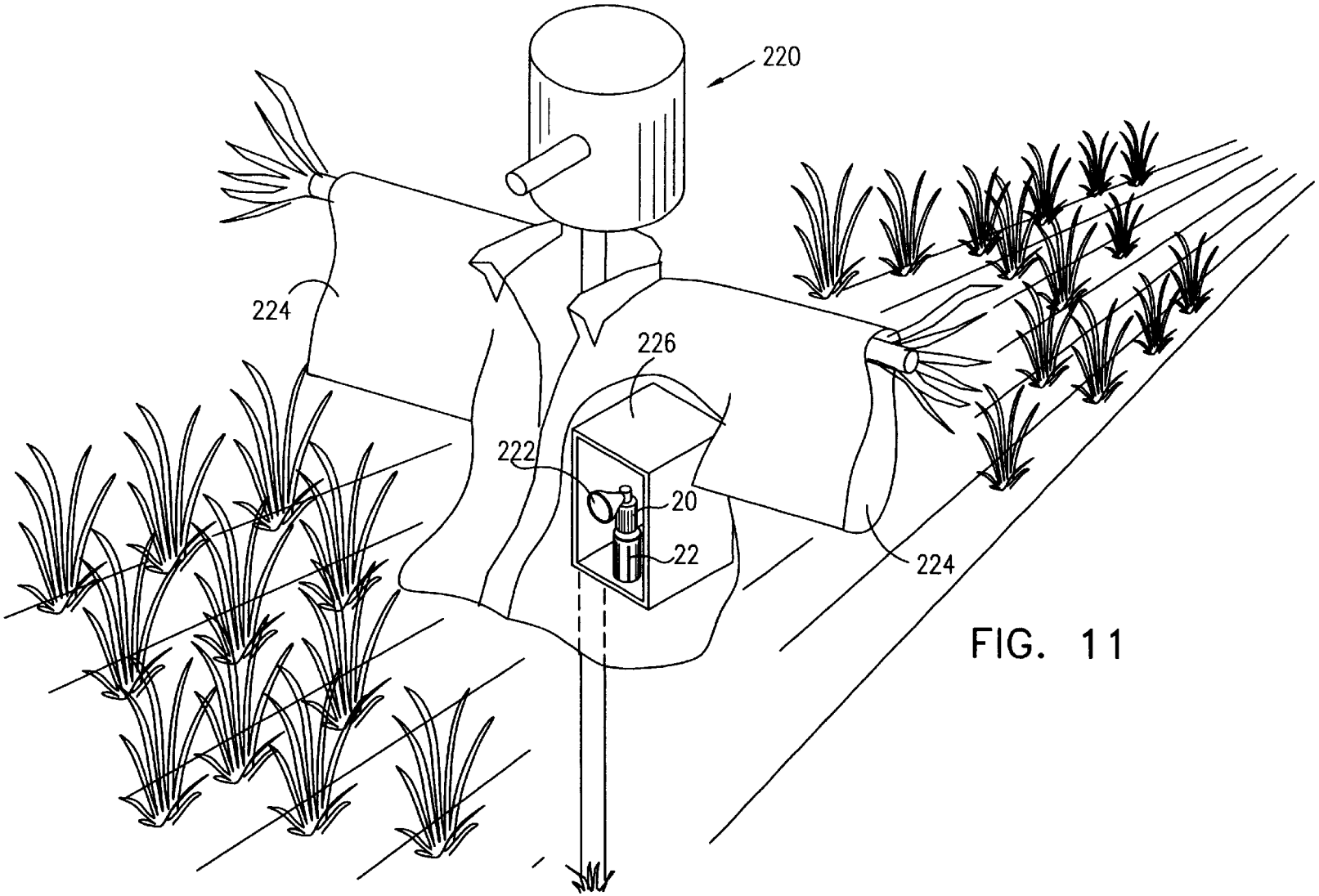
FIG. 11 is a perspective view of a scarecrow utilizing an automatic dispenser, in accordance with a preferred embodiment of the present invention.

FIG. 11 shows an automatic scarecrow 220, in accordance with a preferred embodiment of the present invention. Scarecrow 220 comprises a pressurized gas container 22 with a dispenser 20 mounted thereon, as described above.

A horn orifice head 222 is mounted on dispenser 20, so that every time dispenser 20 is operated, a burst of gas is emitted causing a noise which scares off birds and other unwanted creatures. Horn orifice head 222 may comprise a simple horn, a whistle, a siren, a rattle, a kazoo, or any other suitable sound maker. Preferably, the gas includes an insecticide which eliminates insects which may attract the birds. A protective shield 226 preferably covers dispenser 20 and protects it from weather hazards. In a preferred embodiment of the present invention, the gas emission also causes ribbons 224 to wave, so as to enhance the effect on the birds. Alternatively, an additional dispenser may be used to cause the ribbons to wave, or produce other moving effects. Scarecrow 220 may be positioned near fish ponds, gardens, orchards, runways or any other desired location. In a preferred embodiment of the invention, horn head 222 emits sound mainly at frequencies which are perceived by animals, but not by humans.

In other preferred embodiments of the present invention, dispenser 20 may be positioned within a small doll-shaped scarecrow, preferably mounted on a rotatable hanging device, which is hung on a tree in order to scare off pests from the tree.

In some preferred embodiments of the present invention, dispenser 20 is used to maintain a minimal level of a material in its surroundings. Preferably, dispenser 20 operates responsive to a sensor which measures the level of the material in the surroundings. Each time the level goes below a predetermined threshold, dispenser 20 is operated to emit a quantity of the required material from within container 22. Specific preferred embodiments include maintaining a required smog (for example, to maintain a desired temperature, as is known in the art) or humidity level, particularly within a greenhouse, or an oxygen level in the proximity of a patient.

Figure 12:
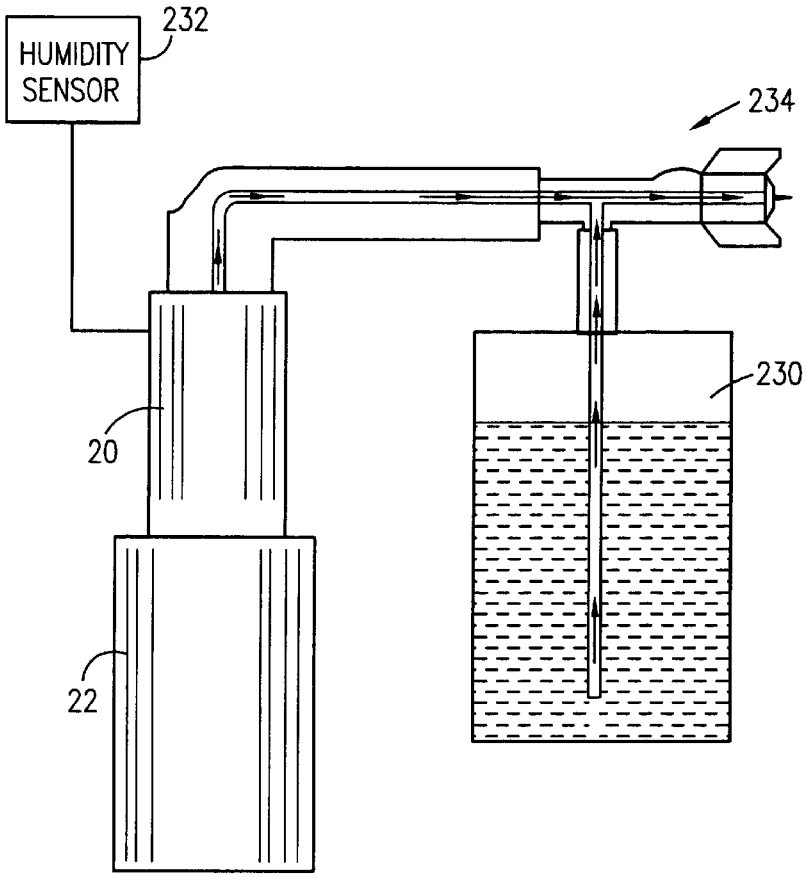
FIG. 12 is a schematic view of a dispenser with a Venturi jet, in accordance with a preferred embodiment of the present invention.

FIG. 12 schematically shows one way to use dispenser 20 for humidity control, in accordance with a preferred embodiment of the present invention. Dispenser 20 is mounted on container 22 containing pressurized gas, preferably air. The orifice of dispenser 20 is connected through a Venturi jet 234 to a water vessel 230. Each time the dispenser operates, water from vessel 230 is sprayed into the surrounding air. Preferably, dispenser 20 is operated responsive to a humidity sensor 232, in order to maintain a minimal humidity level, or a humidity pattern, within the vicinity of dispenser 20. Alternatively, the water from vessel 230 may be used to periodically automatically water plants.

Figure 13:
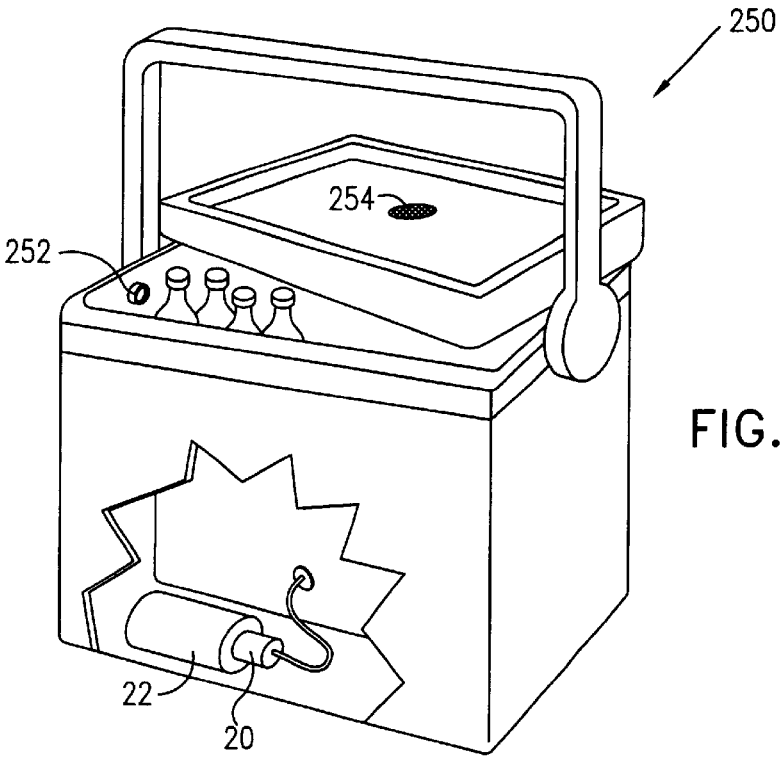
FIG. 13 is a perspective view of a cooler utilizing an automatic dispenser, in accordance with a preferred embodiment of the present invention.

FIG. 13 shows a cooler 250, in accordance with a preferred embodiment of the present invention. Cooler 250 comprises dispenser 20 and container 22, containing a pressurized gas, preferably air, which upon expansion cools and maintains a low temperature within cooler 250. Preferably, dispenser 20 is operated periodically at intervals set according to the environmental temperature. Alternatively or additionally, a temperature sensor 252 initiates the operation of dispenser 20 when the temperature within cooler 250 is above a predetermined threshold. Preferably, the air is allowed out of cooler 250 through a one-way valve 254, which is preferably situated such that the air which leaves cooler 250 is relatively warm air, rather than the cold air which was recently emitted by dispenser 20. It is noted that cooler 250 may be of a variety of sizes, and may similarly comprise a canteen, for cooling water or another drink.

FIGS. 14 and 15 show a cooler 260, in accordance with another preferred embodiment of the present invention. Cooler 260 is similar to cooler 250, but the air flow out of cooler 260, as illustrated in FIG. 15, is planned particularly so as to enhance the cooling effect of the cold gas from dispenser 20. Cooler 260 comprises double walls 261 which enclose a passage 262, which provides thermal insulation. When air is emitted from container 22 into cooler 260, air is not randomly let out of the cooler, but rather the warmest air, near the top of the cooler is pushed out through passage 262. Preferably, the air which is in the cooler for the longest period is emitted. This air flow scheme is reinforced by having the path to one-way valve 254 run all through passage 262.

In other preferred embodiments of the present invention, not shown in the figures, gas in container 22 is used to open and close valves or switches in remote locations or otherwise operate remote systems, for example to automatically launch weather balloons. The use of dispenser 20 as a timing device provides a cheap and reliable method of automatic operation of remote systems, reducing the necessity of access to the system.

In some preferred embodiments of the present invention, not shown in the figures, container 22 contains a fuel, and a flare head is mounted on orifice 36. A spark generator is preferably coupled to dispenser 20, so that the flare is lit up each time dispenser 20 is operated.

In another preferred embodiment of the present invention, container 22 contains a fire extinguisher. Dispenser 20 is coupled to a temperature sensor or smoke sensor so as to emit the contents of the container if a fire is detected.

In a preferred embodiment of the present invention, container 22 contains an anti-vaporizing material which is emitted periodically in suitable locations.

In some preferred embodiments of the present invention, container 22 contains tear gas or other noxious material, and functions as an anti-intrusion device. Dispenser 20 is positioned within a car, for example, and operates if a theft condition is detected.

In some preferred embodiments of the present invention, container 22 contains a colorful smoke material, which is preferably used for signaling purposes. The smoke is emitted from dispenser 20 according to predetermined time settings. Preferably, the emitted smoke also operates a fog-horn as it is emitted. Thus, dispenser 20 may be used, for example, to mark a destination point in navigation.

It will be appreciated that although in the above embodiments, dispenser 20 is used with a pressurized container the present invention may be implemented with non-pressurized containers, for example, for watering plants. In such embodiments the container is preferably positioned upside-down, so that the contents of the container are released due to gravity.

Other possible arrangements of the elements of the above-described preferred embodiments will also be apparent to those skilled in the art and are included within the scope of the present invention. For example, elements of shaft 52 (FIG. 6) may be reversed so that hole 90 is positioned within upper bore 58, and controls the outflow of fluid from the shaft, rather than controlling influx into the shaft as described above. It will be appreciated that the preferred embodiments described above are cited by way of example.

What is claimed is:

1. A dispenser for attachment to a container having a container opening valve and containing a fluid material, comprising:

an actuator for keeping the container opening valve in a substantially constantly open configuration so as to allow the fluid to pass into the dispenser; and a controllable outlet comprising a dispensing valve that is operated independently of the container opening valve, through which outlet a portion of the fluid is emitted from the dispenser, substantially independent of the fluid pressure in the container.

2. A dispenser as in claim 1, wherein the fluid material in the container is pressurized.

3. A dispenser as in claim 1, wherein the fluid material in the container is non-pressurized.

4. A dispenser as in claim 1, wherein the size of the emitted portion is controlled by varying an amount of time in which the controllable outlet is in an open state.

5. A dispenser as in claim 1, wherein the dispenser has an open stare in which the fluid is emitted from the dispenser, and a closed state in which the fluid is prevented from leaving the dispenser, and wherein the dispenser consumes energy substantially only during transition between the open and closed states.

6. A dispenser as in any of the preceding claims, and comprising an electric motor which controls passage of the portion of the fluid through the outlet.

7. A dispenser as in claim 1, wherein the dispenser has a bore therethrough, which receives the fluid from the container valve, the bore comprising a first part having a first inner diameter and a second part having a second inner diameter, larger than the first inner diameter, wherein the dispenser includes:

a hollow shaft, axially movable within the bore, the shaft having a hole disposed along the length thereof such that when the hole is positioned in the first part of the bore, the fluid does not pass through the shaft, and when the hole is in the second part of the bore, the fluid passes through the shaft and is emitted from the dispenser.

8. A dispenser as in claim 7, and comprising a lever connected to the shaft, such that the shaft is axially moved by the lever.

9. A dispenser as in claim 8, and comprising a screw which drives the lever, wherein the lever comprises an internal thread for receiving the screw.

10. A dispenser as in claim 7, wherein the outlet includes an orifice through which the material is emitted, and wherein the size of the orifice is not substantially smaller than the size of the hole, so that a gas leaving the container does not expand within the dispenser.

11. A dispenser as in claim 1, wherein the dispenser operates substantially without dependence on gears or cams.

12. A dispenser as in claim 1, wherein the actuator comprises a plunger which depresses the container valve.

13. A dispenser as in claim 1, wherein the actuator comprises a hose.

14. A dispenser as in claim 1, and comprising a processor which periodically actuates emission of the fluid.

15. A dispenser as in claim 14, and comprising a user interface for controlling the operation of the dispenser.

16. A dispenser as in claim 14, wherein the processor is programmed to actuate different emission durations at different times.

17. A dispenser as in claim 1, wherein the dispenser comprises an adapter for attaching the dispenser to different types of containers.

18. A dispenser as in claim 1, wherein the dispenser is portable.

19. A dispenser as in claim 1, wherein the fluid is dispensed to water a plant.

20. A dispenser as in claim 1, wherein the fluid comprises a deodorant.

21. A dispenser as in claim 1, wherein the fluid comprises an insecticide.

22. A dispenser as in claim 1, wherein the fluid comprises a smoke-producing material.

23. A dispenser as in claim 1, and comprising a horn mounted on the dispenser so as to make a sound when the fluid is emitted.

24. A dispenser as in claim 1, wherein the fluid is emitted as an aerosol.

25. A dispenser as in claim 1, and comprising a hanger for hanging the dispenser such that the dispenser is free to turn.

26. A dispenser for attachment to a container having a container valve and containing a fluid material, comprising:

a dispensing valve;

an actuator for keeping the container opening valve substantially constantly in an open configuration so as to allow the fluid to pass into the dispenser; and an electric motor, which opens the dispensing valve so that fluid is emitted therefrom and closes the dispensing valve to prevent the fluid emission, wherein the container valve and the dispensing valve are independently operated.

27. A dispenser as in claim 26, wherein the motor is battery operated.

28. A dispenser as in claim 26, wherein the motor is connected to an electric line.

29. A dispenser as in any of claims 6–28, wherein the motor opens and closes the dispenser by a rotational movement.

30. A dispenser as in claim 26, wherein the dispenser has a bore therethrough, which receives the fluid from the container valve, the bore comprising a first part having a first inner diameter and a second part having a second inner diameter, larger than the first inner diameter, wherein the dispenser includes:

a hollow shaft, axially movable within the bore, the shaft having a hole disposed along the length thereof such that when the hole is positioned in the first part of the bore, the fluid does not pass through the shaft, and when the hole is in the second part of the bore, the fluid passes through the shaft and is emitted from the dispenser.

31. A dispensing container comprising;

a can containing a fluid;

the can having a dispenser head including a dispensing valve comprising a movable hollow shaft having a hole which has an open state in which the fluid is emitted from the can and a closed state in which the fluid is not emitted; and a motor which changes the state of the dispensing valve between the state in which the hole is open and the state in which the hole is closed, wherein the dispensing valve operates substantially independently of the fluid pressure in the container.

32. A dispenser as in claim 31, wherein the dispenser head has a bore therethrough, which receives the fluid from the can, the bore comprising a first part having a first inner diameter and a second part having a second inner diameter, larger than the first inner diameter, wherein the dispenser head includes:

a hollow shaft, axially movable within the bore, the shaft having a hole disposed along the length thereof such that when the hole is positioned in the first part of the bore, the fluid does not pass through the shaft, and when the hole is in the second part of the bore, the fluid passes through the shaft and is emitted from the dispenser head.

33. A method for dispensing a material from a container having a container valve, comprising:

fixing a dispenser having a dispensing valve to the container, such that the dispenser holds the container valve in a substantially constantly open position, so as to allow the material to pass into the dispenser; and emitting the material from the dispenser substantially independently of the pressure of the material in the containers, wherein the container valve and the dispensing valve are independently operated.

34. The method of claim 33, wherein fixing the dispenser to the container comprises fixing the dispenser to a container containing a pressurized material.

35. The method of claim 33, wherein the dispenser includes an electric motor, and emitting the material comprises actuating the motor so as to cause the material to be emitted.

36. The method of claim 35, wherein actuating the motor comprises driving a rotational movement using the electric motor.

37. The method of claim 33, wherein emitting the material comprises emitting the material periodically.

38. The method of claim 33, wherein emitting the material comprises emitting the material at a first rate during a first period and emitting the material at a second rate during a second period.

39. The method of claim 33, wherein emitting the material comprises emitting the material in response to an external signal.

40. The method of claim 39, wherein emitting the material comprises emitting the material in response to a signal received from a sensor.

41. The method of claim 33, wherein emitting the material comprises emitting an aerosol.

42. The method of claim 33, wherein emitting the material comprises emitting a deodorant.

43. The method of claim 33, wherein emitting the material comprises emitting an insecticide.

44. The method of claim 33, wherein emitting the material comprises emitting smoke.

45. The method of claim 33, wherein emitting the material comprises watering a plant.

46. The method of claim 33, and comprising hanging the dispenser such that it is free to turn.

47. The method of claim 33, wherein emitting the material comprises bringing the dispenser from a closed state to an open state in which the material is emitted from the dispenser, and wherein the dispenser consumes energy substantially only during transition between the open and closed states.

48. A method of pest control comprising:

mounting an automatic dispenser having a horn head on a pressurized gas container; and operating the dispenser automatically to periodically emit a portion of the gas in the container so as to operate the horn, wherein periodically emitting the gas comprises emitting gas in response to detection of a pest, whereby gas is not periodically emitted in the absence of a pest.

49. The method of claim 48; wherein periodically emitting the gas comprises emitting gas so as to cause movement disturbing to the pest.

50. The method of claim 48, wherein periodically emitting the gas comprises emitting gas so as to cause movement disturbing to the pest.

51. A method of pest control according to claim 48, wherein the gas in the container performs a pest disturbing function other than and simultaneously with operation of the horn.

* * * * *